US006050090A

United States Patent [19]

Tohji

[11] Patent Number: 6,050,090

[45] Date of Patent: Apr. 18, 2000

[54] CONTROL APPARATUS FOR HYDRAULIC EXCAVATOR

[75] Inventor: Yutaka Tohji, Hiroshima, Japan

[73] Assignee: Kabushiki Kaisha Kobe Seiko Sho, Kobe, Japan

[21] Appl. No.: 08/873,085

[22] Filed: Jun. 11, 1997

[30] Foreign Application Priority Data

| | | | |
|---|---|---|---|
| Jun. 11, 1996 | [JP] | Japan | 8-148951 |
| Jun. 12, 1996 | [JP] | Japan | 8-150884 |
| Jul. 5, 1996 | [JP] | Japan | 8-176740 |

[51] Int. Cl.[7] ..... F15B 13/02

[52] U.S. Cl. ..... 60/421; 60/446; 60/426

[58] Field of Search ..... 60/426, 446

[56] References Cited

U.S. PATENT DOCUMENTS

| | | | |
|---|---|---|---|
| 4,768,339 | 9/1988 | Aoyagi et al. | 60/427 |
| 4,945,723 | 8/1990 | Izumi et al. | 60/426 |
| 5,062,350 | 11/1991 | Tanaka et al. | 60/427 X |
| 5,063,741 | 11/1991 | Miyaoka | 60/461 |
| 5,267,440 | 12/1993 | Nakamura et al. | 60/426 |
| 5,289,679 | 3/1994 | Yasuda | 60/422 |
| 5,383,390 | 1/1995 | Lukich | 60/426 X |
| 5,460,001 | 10/1995 | Kato et al. | 60/426 |
| 5,469,646 | 11/1995 | Takamura | 37/382 |
| 5,520,087 | 5/1996 | Takamura et al. | 60/422 X |
| 5,537,819 | 7/1996 | Kobayashi | 60/459 |
| 5,673,558 | 10/1997 | Sugiyama et al. | 60/426 |
| 5,835,874 | 11/1998 | Hirata et al. | 60/426 X |
| 5,873,245 | 2/1999 | Kato et al. | 60/445 |

*Primary Examiner*—John E. Ryznic

*Attorney, Agent, or Firm*—Oblon, Spivak, McClelland, Maier & Neustadt, P.C.

[57] ABSTRACT

Pressure sensors sense a pilot pressure Pa corresponding to the amount of boom raising operation of a boom operation lever and a pilot pressure Pb corresponding to the amount of arm pulling operation of an arm operation lever. When the condition of Pa>Pb is met during the horizontal pulling operation, the rate of supply of the working fluid to an arm actuating cylinder is reduced to a rate corresponding to the amount of operation of the operation lever. Conversely, when the condition Pa<Pb is met, the rate of supply of the working fluid to the boom actuating cylinder 5 is reduced to a rate corresponding to the amount of operation of the operating lever. Horizontal pulling operation for levelling the ground can be conducted without requiring high level of skill. The horizontal pulling work can be done easily and smoothly, while preventing the bucket from cutting into the ground and from floating above the ground.

41 Claims, 15 Drawing Sheets

CONTROL APPARATUS FOR HYDRAULIC EXCAVATOR

BACKGROUND OF THE INVENTION

1. Field of the Invention

The present invention relates to a hydraulic excavator and, more particularly, to a control apparatus for use on a hydraulic excavator.

2. Description of the Related Art

In general, a hydraulic excavator has a hydraulic pump mounted on a carrier vehicle, for supplying pressurized working fluid to actuators such as a boom actuating hydraulic cylinder or an arm actuating hydraulic cylinder. Spool valves for switching the flowing direction of the working fluid are provided in the fluid passages between the hydraulic pump and the respective actuators. Each spool valve is supplied with a pilot pressure of a level corresponding to the amount of operation of an operation lever for controlling the associated actuator, so that the spool valve is displaced by an amount corresponding to the amount of operation of the operation lever. Consequently, pressurized working fluid is supplied to each actuator at a rate which corresponds to the amount of operation of the associated operation cylinder, whereby the actuator operates at a speed which corresponds to the amount of operation of the operation lever. This general arrangement and operation principle are well known in the art.

The hydraulic pump used on this type of hydraulic excavator is either a constant displacement pump or a variable displacement pump. In the latter case, independent variable displacement pumps are used for the boom actuating cylinder and the arm actuating cylinder. Thus, the displacement rates of the respective hydraulic pumps are controlled to values corresponding to the amounts of operations of the boom operation lever and the arm operation lever.

Another known hydraulic excavator has such a hydraulic system that, while separate hydraulic pumps are arranged for a boom actuating cylinder and an arm actuating cylinder, respectively, one of the hydraulic pumps assists the other as the occasion demands. When a boom operation lever is operated, an associated hydraulic pump (referred to as a "first hydraulic pump", hereinafter) supplies the boom actuating cylinder with the pressurized working fluid through the aforementioned spool valve (this valve is referred to as a "boom spool valve", hereinafter) and, at the same time, working fluid displaced from the hydraulic pump associated with the arm actuating cylinder (this pump will be referred to as a "second hydraulic pump", hereinafter) is caused to join in the working fluid from the first hydraulic pump, so as to be supplied to the boom actuating cylinder together with the fluid from the first hydraulic pump. This hydraulic system realizes a comparatively high speed of boom operation which is conveniently used in, for example, loading of soil on a truck.

When the hydraulic pumps used in the hydraulic system of the type described above, the displacement rates of these pumps are controlled in accordance with the amounts of operations of the associated operation levers. When the fluid joining operation is executed, the second hydraulic pump is required to supply the arm actuating cylinder with the pressurized working fluid in accordance with the operation of the arm operation lever and, at the same time, to the boom actuating cylinder. Thus, the displacement rate of the second hydraulic pump is increased in response to the operation of the boom operation lever. The fluid system for implementing the joining of the working fluid usually employs a boom fluid joining valve and a cut valve. The boom fluid joining valve serves to selectively open and close the fluid passage leading from the second hydraulic pump to the boom actuating cylinder, while the cut valve operates to selectively open and close a fluid passage through which the hydraulic fluid from the second hydraulic pump is returned to and collected in a working fluid tank through the arm spool valve when the latter is in a neutral position as a result of setting of the arm operation lever to a neutral position. By operating the boom fluid joining valve and the cut valve to the opening and closing positions, respectively, it is possible to join the working fluid from the second hydraulic pump in the working fluid from the first hydraulic pump, so that the working fluid from the second hydraulic pump is supplied together with the working fluid from the first hydraulic pump to the boom actuating cylinder.

It is also known to provide, in this type of hydraulic excavator, a returning circuit which allows the hydraulic fluid displaced from the rod-side chamber of the arm actuating cylinder to directly return to the bottom-side chamber of the arm actuating cylinder, for various purposes such as prevention of cavitation which is liable to occur when the arm actuating cylinder is being extended, i.e., when the arm is being pulled, effective use of the hydraulic fluid discharged from the rod-side chamber of the arm cylinder, increase of the operation speed of the arm actuating cylinder, and so forth.

A hydraulic excavator often conducts an operation for horizontally pulling a bucket on the end of an arm, for the purpose of levelling the ground. This operation will be referred to as "horizontal pulling operation". In order that the hydraulic excavator performs such a horizontal pulling operation or action, the boom operation lever and the arm operation lever are operated such that the boom is raised while the arm is pulled. If the amount of operation of the boom operation lever associated with the boom actuating cylinder for raising the boom is equal to the amount of operation of the arm operation lever associated with the arm actuating lever for pulling the arm, the boom actuating cylinder and the arm actuating cylinder are operated such that the bucket is horizontally pulled towards the vehicle. In this case, the pilot pressure supplied to the boom spool valve and the pilot pressure supplied to the arm spool valve are in 1:1 relation to each other.

However, the simultaneous operations of the boom operation lever and the arm operation lever in the boom raising direction and in the arm pulling direction by the same amount, for realizing the horizontal pulling of the bucket, requires a high level of skill and experience. In general, it is difficult to simultaneously operate both the boom operation lever and the arm operation lever in the manner described.

As a consequence, it is often experienced that the amount of operation of one of the boom operation lever and the arm operation lever exceeds the amount of operation of the other, with the result that the speed of operation of the arm actuating cylinder for pulling the arm is too high or too low as opposed to the speed of operation of the boom actuating cylinder for raising the boom.

This problem is serious particularly in the case of a hydraulic excavator of the type in which hydraulic fluid is supplied to the boom actuating cylinder from both the first and second hydraulic pumps during the operation of the boom. In this type of hydraulic excavator, the joining of the working fluid from both hydraulic pumps is carried out over a wide range of operation of the boom operation lever.

Consequently, the speed of operation of the boom actuating cylinder for raising the boom tends to be too fast with respect to the arm pulling speed of the arm actuating cylinder, even by a small increment of the operation amount of the boom operation lever.

The same problem is encountered even in the case of a hydraulic excavator of the type which does not employ the function of joining of fluid from both hydraulic pumps. Namely, certain levels of skill and experience is required for simultaneously operating the boom operation lever and the arm operation lever such that the operating speeds of the boom actuating cylinder and the arm Actuating cylinder match with each other to achieve the horizontal pulling action. It is thus often experienced that the operation speed of one of the boom actuating cylinder and the arm actuating cylinder is too fast or too low with respect to the operation speed of the other.

When the operation speed of the arm actuating cylinder is too high with respect to the operation speed of the boom actuating cylinder, the end of the arm tends to be lowered, with the result that the bucket cuts into the ground to roughen the levelled ground surface.

Conversely, a too slow speed of operation of the arm actuating cylinder with respect to the operation speed of the boom actuating cylinder tends to lift the end of the arm away from the ground, with the result that the bucket floats above the ground surface, failing to level the ground. In this state, it is impossible to conduct the levelling.

SUMMARY OF THE INVENTION

Accordingly, it is an object of the present invention to provide a hydraulic excavator which can perform levelling of the ground by horizontally pulling the bucket, without requiring any specific skill or experience in operating the boom operation lever and the arm operation lever.

Another object of the present invention is to provide a hydraulic excavator which enables horizontal pulling action for levelling the ground to be performed easily and smoothly, by preventing the bucket from cutting into the ground or floating above the ground.

In a hydraulic excavator in accordance with the present invention, a boom spool valve for controlling a boom actuating cylinder and an arm spool valve for controlling an arm actuating cylinder are displaced in accordance with the amounts of operations of a boom operation lever and an arm operation lever, respectively, so that said boom actuating cylinder and said arm actuating cylinder are supplied with pressurized working fluid at rates determined in accordance with the amounts of operations of the operation levers, whereby the boom actuating cylinder and the arm actuating cylinder operate at speeds corresponding to the amounts of operations of the operation levers.

According to the invention, any imbalance between the amount of boom operation and the amount of arm operation is detected, and a control is performed in accordance with the result of the detection so as to prevent the bucket from cutting into or floating above the ground.

A preferred form of the hydraulic excavator of the present invention detects the amount of operation of the boom operation lever in the direction for raising the boom and the amount of operation of the arm operation lever in the direction for pulling the arm. When the amount of arm operation is not smaller than a predetermined speed in terms of the ratio to the amount of operation of the boom while the boom actuating cylinder and the arm actuating cylinder are simultaneously in operation for raising the boom and for pulling the arm, respectively, a control is performed so as to reduce the rate of supply of the working fluid to the arm actuating cylinder to a value corresponding to the amount of operation of the boom operation lever.

In such a case, the arm actuating cylinder is supplied with the working fluid at a rate which is the same as that rate which would be obtain ed when the amount of operation of the arm operation lever is equal to that of the boom operation lever. As a result, the operation speed of the arm actuating cylinder is prevented from becoming excessively high with respect to that of the boom actuating cylinder, whereby inconvenience such as cutting of the bucket into the ground is avoided. It is therefore possible to conduct the horizontal pulling action without roughening the levelled ground surface.

It is more preferred that the arm spool valve is of the type which permits the working fluid to be supplied to the arm actuating cylinder at a rate corresponding to the amount of operation thereof, upon receipt of a pilot pressure which corresponds to the lever operation amount.

When such a type of spool valve is used as the arm spool valve, reduction of the pilot pressure applied to the arm spool valve down to the level corresponding to the amount of operation of the boom operation lever produces such a result that the arm spool valve is set to a state which is the same as that obtained when the arm operation lever is operated by the same amount as that of operation of the boom operation lever. As a result, the rate of supply of the working fluid to the arm actuating cylinder is reduced to a rate corresponding to the amount of operation of the boom operation lever, so that the operation speed of the arm actuating cylinder is reduced to the speed which matches with the speed of operation of the boom actuating cylinder.

In this type of hydraulic excavator, a further improvement can be achieved by arranging such that the rate of supply of the working fluid to the boom actuating cylinder is reduced to a rate corresponding to the amount of operation of the arm operation lever, when the amount of movement of the boom during the horizontal pulling action is not smaller than a certain value in terms of the ratio to the amount of movement of the arm.

The bucket tends to float above the ground during the horizontal pulling, when the amount of movement of the boom is greater than the amount which would match with the amount of movement of the arm during the horizontal pulling action. In such a case, the rate of supply of the working fluid to the boom actuating cylinder is reduced to a rate corresponding to the amount of operation of the arm operation lever. Consequently, the operation speed of the boom actuating cylinder is prevented from becoming excessively large with respect to the speed of operation of the arm actuating cylinder, thus avoiding undesirable floating of the bucket above the ground. Thus, the bucket is prevented not only from cutting into the ground but also from floating above the ground, thus enabling easy and smooth horizontal pulling operation.

A further improvement will be achieved if the boom spool valve is designed and constructed such that it allows the working fluid to be supplied to the boom actuating cylinder at a rate which corresponds to the amount of operation of the boom operation lever, upon receipt of a pilot pressure of a level which corresponds to the amount of operation of the boom operation lever.

The arrangement also is preferably such that the displacement rates of the hydraulic pumps are controlled in accordance with the amounts of operations of the boom operation lever and the arm operation lever.

Such an arrangement provides a matching between the rates of displacement of the working fluids from the hydraulic pumps and the rate of supply of the working fluid to the arm actuating cylinder, thus ensuring stable behavior of the arm actuating cylinder.

An arrangement also is preferred in which, when the amount of operation of the boom during horizontal pulling operation is not smaller than a predetermined value in terms of the ratio to the amount of movement of the arm, the rate of supply of the working fluid to the boom actuating cylinder is reduced to a rate which corresponds to the amount of operation of the arm operation lever.

According to this arrangement, the rate of displacement of the working fluid from the hydraulic cylinder corresponding to the boom cylinder is reduced to a rate smaller than the rate corresponding to the amount of operation of the boom actuating lever, without requiring any positive operation for reducing the rate of supply of the working fluid to the boom actuating cylinder, thus suppressing any tendency for the boom to rise above the ground. The rising tendency of the boom is suppressed also by the force of gravity which acts to lower the boom.

Another preferred form of the hydraulic excavator of the present invention comprises, in order to prevent floating of the bucket during horizontal pulling operation, a first variable displacement hydraulic pump for supplying the working fluid to the boom actuating cylinder, a second variable displacement hydraulic pump for supplying the working fluid to the arm actuating cylinder, a boom spool valve provided in the working fluid passage through which the working fluid is supplied from the first variable displacement hydraulic pump to the boom actuating cylinder, and an arm spool valve provided in a the working fluid passage through which the working fluid is supplied from the second variable displacement hydraulic pump to the arm actuating cylinder. When both the boom operation lever and the arm operation lever are simultaneously in operation for raising the boom and for pulling the arm, respectively, the rate at which the working fluid is displaced from the first variable displacement hydraulic pump is reduced to a rate which corresponds to the amount of operation of the arm operation lever, on condition that the ratio of the amount of operation of the boom to the amount of operation of the arm is not smaller than a predetermined value.

Thus, the displacement rate of the hydraulic pump associated with the boom actuating cylinder is reduced to a rate which corresponds to the amount of operation of the arm operation lever and which is smaller than that corresponding to the amount of operation of the boom operation lever. At the same time, the boom tends to come down due to its weight. Consequently, any tendency for the boom to rise is suppressed.

A further improvement of the hydraulic excavator described hereinbefore can be achieved by arranging such that the control for reducing the rate of supply of the working fluid to the arm actuating cylinder or the boom actuating cylinder is prohibited in accordance with a predetermined operation, or such that the control for reducing the displacement rate from the first variable displacement hydraulic pump is prohibited in accordance with a predetermined operation, for the reasons stated below.

In general, hydraulic excavator is required to perform various types of jobs which are implemented by combination of operations of the boom and arm. Not only the horizontal pulling work but also other types of job require the simultaneous operation of the boom operation lever and the arm operation lever for raising the boom and pulling the arm simultaneously. In such jobs other than the horizontal pulling work for levelling the ground, it is often preferred that the boom actuating cylinder and the arm actuating cylinders are supplied with working fluids at rates which are independent of each other. Such jobs can efficiently and easily be done when the prohibiting function stated above is available for allowing the boom and arm to be raised and pulled, respectively, purely in accordance with the operations of the associated levers.

Another preferred form of the hydraulic excavator in accordance with the present invention comprises: a variable orifice capable of varying the area of the fluid passage therein, provided in a hydraulic passage through which the fluid is discharged from the rod-side chamber of the arm actuating cylinder during arm pulling operation of the same; and variable orifice controlling means for controlling, when both the boom operation lever and the arm operation lever are simultaneously in operation for raising the boom and for pulling the arm, respectively, the area of the passage in the variable orifice in accordance with the amount of operation of the boom operation lever, such that the smaller the amount of operation of the boom operation lever, the smaller the area of the passage in the variable orifice.

In this hydraulic excavator, when the amount of operation of the arm operation lever is increased as compared with the amount of operation of the boom operation lever during the horizontal pulling work, the aforementioned arm spool valve which is operated in accordance with the amount of operation of the arm operating lever serves to increase the rate of supply of the pressurized working fluid to the bottom-side chamber of the arm actuating cylinder from the associated hydraulic pump, tending to increase the speed of operation of the arm actuating cylinder. In the meantime, the variable orifice disposed in the passage leading from the rod-side chamber of the arm actuating cylinder is controlled in accordance with the amount of operation of the boom operation lever which is smaller than the amount of operation of the arm operation lever.

Consequently, the variable orifice is controlled so as to provide a comparatively small passage area corresponding to the small amount of operation of the boom operation lever, rather than a comparatively large area which would corresponds to the amount of operation of the arm operation lever. Consequently, the flow of the fluid discharged from the rod-side chamber of the arm actuating cylinder is restricted to suppress rise of the operation speed of the arm actuating cylinder, despite the large amount of operation of the arm operation lever as compared with the amount of operation of the boom operation lever. This effectively prevents the operation speed of the arm actuating cylinder for pulling the arm from becoming excessively high as compared with the operation of the boom actuating cylinder for raising the boom, thus preventing the bucket on the end of the arm from cutting into the ground. It is therefore possible to easily and smoothly conduct levelling of the ground by the horizontal pulling operation, without roughening the levelled ground surface.

A further improvement can be achieved by arranging such that the displacement rates of the respective hydraulic pumps are controlled in accordance with the amounts of operations of the boom operation lever and the arm operation lever, wherein, when the boom operation lever and the arm operation lever are simultaneously in operation for raising the boom and for pulling the arm, respectively, the displacement rate from the hydraulic pump associated with the arm cylinder is controlled to a rate which corresponds to the smaller one of the amount of operation of the boom operation lever and the amount of operation of the arm operation lever.

According to this arrangement, when the amount of operation of the arm operation lever has become large as compared with the amount of operation of the boom operation lever, excessive rise of the speed of operation of the arm actuating cylinder as compared with the operation speed of the boom operation cylinder, by virtue of the control of the aforementioned variable orifice. In addition, the rate of displacement from the hydraulic pump supplying the fluid to the arm actuating cylinder is controlled to a rate which corresponds to the amount of operation of the boom operation lever which is smaller than the amount of operation of the arm operation lever and which matches with the retarded operation speed of the arm actuating cylinder, whereby the behavior of the arm actuating cylinder is stabilized.

A further improvement is achievable in this hydraulic excavator, by arranging such that the displacement rate varying characteristic, i.e., the rate at which the displacement rate is varied for a given amount of change of operation of the operation lever, is variable for each of the variable displacement hydraulic pump.

Such an arrangement permits the operator to operate the boom actuating cylinder and the arm actuating cylinder with operation characteristics or behaviors which conform his favor or which are optimum for the type and condition of the horizontal pulling work.

It is also preferred that the hydraulic excavator of the type described is equipped with a returning circuit which permits the fluid discharged from the rod-side chamber of the arm actuating cylinder to return directly to the bottom-side chamber, during the operation of the arm actuating cylinder for pulling the arm. The variable orifice mentioned before is disposed in this returning circuit.

According to such an arrangement, the fluid discharged from the rod-side chamber of the arm actuating cylinder to return directly to the bottom-side chamber through the returning circuit having the variable orifice, during the operation of the arm actuating cylinder for pulling the arm. Consequently, the tendency for the operation speed of the arm actuating cylinder to increase is suppressed when the variable orifice is controlled to restrict the passage area in the manner described before, thus eliminating undesirable operation such as cutting of the ground by the bucket.

In still another preferred form of the hydraulic excavator of the present invention, the working fluid displaced from the second hydraulic pump is made to join in the working fluid displaced from the first hydraulic pump so as to be supplied to the boom actuating cylinder together with the fluid from the first hydraulic pump, in accordance with the operation of the boom operation lever. It is preferred that, when the boom operation lever and the arm operation lever are simultaneously operated for raising the boom and for pulling the arm, respectively, the timing at which the fluid joining operation is commenced is delayed, at the earliest, behind the moment at which the fluid joining operation would be commenced when the boom operation lever alone were operated.

In such an arrangement, since the timing at which the operation for joining the working fluid is delayed behind the timing at which the joining would be commenced when the boom operation lever alone is operated, the operation for joining the working fluid from the second hydraulic pump in the fluid from the first hydraulic pump does not start unless the boom operation lever is operated by a greater amount than usual. When the fluid joining operation is not conducted, the boom operating cylinder is supplied with the working fluid from the first hydraulic pump alone, so that any slight change on the amount of operation of the boom operation lever does not cause a rapid change in the operation speed of the boom actuating cylinder. Therefore, the range of operation of the operation lever over which the operating speed of the boom actuating cylinder is easily controllable is widened as compared with that in the ordinary operation. With this function, the operator can easily adjust the speed of the boom raising operation of the boom actuating cylinder so as to obtain matching between the boom raising speed and the arm pulling speed, thus facilitating the horizontal pulling operation. Consequently, the horizontal pulling work can be performed easily and smoothly without requiring high degree of skill and experience.

The described hydraulic excavator preferably has a boom fluid joining valve which can selectively open and close the path of the working fluid between the second hydraulic pump and the boom actuating cylinder, and a cut valve which can selectively open and close a passage through which the working fluid from the second hydraulic pump is collected in a hydraulic fluid tank through the arm spool valve when the latter is in its neutral position in response to the setting of the arm operation valve to the neutral position.

The arrangement may be such that, when it is desired to conduct the joining of the working fluid for the operation of the boom actuating cylinder, at least one of the timing of opening of the boom fluid joining valve and the timing of closing of the cut valve is delayed behind the timing at which such opening or closing would occur when the boom operation lever alone is operated. When the opening of the boom fluid joining valve is delayed, the passage from the second hydraulic pump and the boom actuating cylinder is kept closed until this valve is opened, so that the timing at which the joining of the fluid from the second hydraulic pump to the fluid to be supplied to the boom actuating cylinder is delayed behind the timing at which the joining would be commenced in usual operation. Similarly, when the closing of the cut valve is delayed, the working fluid displaced from the second hydraulic pump is allowed to flow into the working fluid tank until the cut valve is closed, so that the timing at which the joining of the fluid is commenced is delayed behind the timing at which the joining of the fluid would be commenced in usual operation. It is thus possible to delay, without difficulty, the timing at which the joining of the working fluid from the second hydraulic pump to the fluid to be supplied to the boom actuating cylinder, during the horizontal pulling operation of the hydraulic excavator. The delay may be effected both on the timing of opening of the boom fluid joining valve and the timing of closing of the cut valve.

A further preferred form of the hydraulic excavator in accordance with the present invention is arranged such that, when the boom operation lever and the arm operation lever are simultaneously in operation for raising the boom and for pulling the arm, respectively, the timing at which the increase of the displacement rate of the second variable displacement hydraulic pump in response to the operation of the boom operation lever is delayed behind the timing at which the increase of the displacement rate would be commenced when the boom operation lever alone is operated.

According to this arrangement, when the horizontal pulling operation is conducted, unless the boom operation lever is operated by an amount greater than that in the case where no delay is effected, the rate of supply of the working fluid from the second variable displacement pump to the boom actuating cylinder is smaller than that in the case where no such delay is effected. Namely, most of the working fluid to be supplied from the boom actuating cylinder comes from the first hydraulic pump. Under such a condition, rapid change in the operation speed of the boom actuating cylinder for raising the boom is suppressed to occur. Thus, the range of operation of the boom operation lever over which the control of operation speed of the boom actuating cylinder is easily controllable is widened as compared with that in usual operation. This enables the operator to more easily control the boom raising operation of the boom actuating cylinder so as to obtain matching with the arm pulling operation of the arm actuating cylinder. As a result, the horizontal pulling work for levelling the ground by horizontal pulling of the bucket can be conducted easily and smoothly, without requiring any high degree of skill and experience in the operation of the boom operation lever and the arm operation lever.

DESCRIPTION OF THE PREFERRED EMBODIMENTS

A first embodiment of the present invention will be described with reference to FIGS. 1 to 6.

Figure 1:
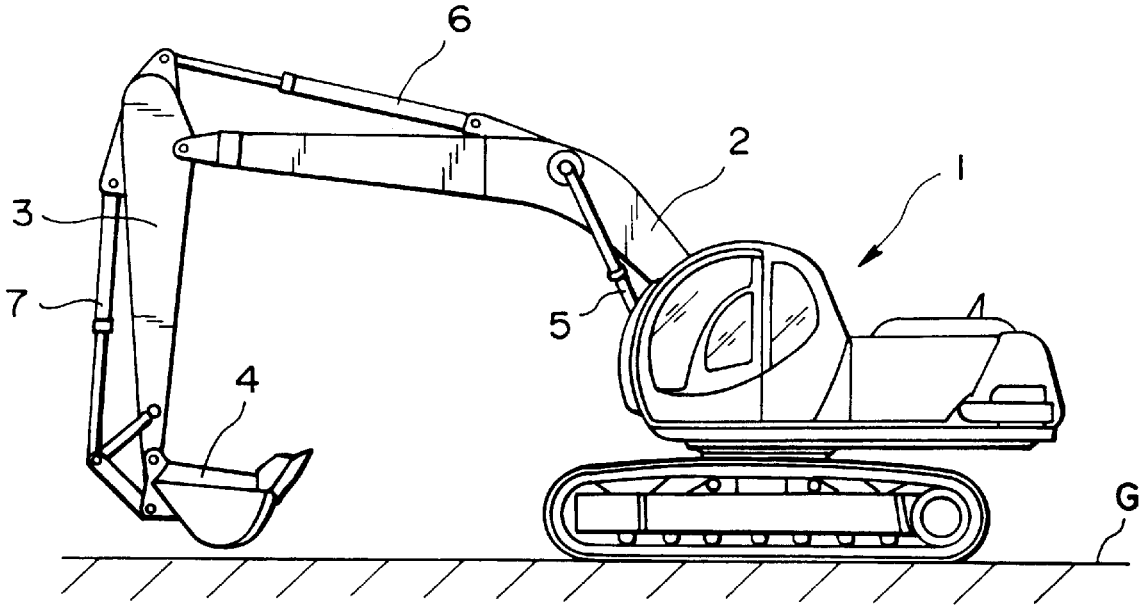
FIG. 1 is a side elevational view of a hydraulic excavator as an embodiment of the present invention.

Referring first to FIG. 1, a hydraulic excavator in accordance with the present invention has a chassis 1, a boom vertically swingably mounted on a front portion of the chassis 1, and an arm 3 swingably mounted on the free end of the boom 2 so as to swing back and forth. Further, a bucket 4 is pivotally is mounted on the free end of the arm 3 so as to be able to swing back and forth. A pair of boom actuating cylinders 5, arranged on both sides of the boom 2, are connected between a rear end portion of the boom and the chassis 1 so as to be able to extend and contract, thereby causing vertical swinging motion of the boom 2. An arm actuating cylinder 6 is connected between a rear end portion of the arm 3 and the boom 2 so as to be able to extend and contract, thereby causing the arm 3 to swing forward and backward. The bucket 4 is actuated by a bucket actuating cylinder 4 which acts between the bucket 4 and the arm 3 so as to extend and contract.

Horizontal pulling work for levelling the ground G is conducted by setting the bucket 4 in contact with the ground G and operating the arm actuating cylinder 6 such that this cylinder 6 extends so as to pull the arm 3 towards the chassis 1, while operating the pair of boom actuating cylinders 5 such that these cylinders extend so as to raise the boom 2, in such a manner that the bucket 4 on the end of the arm 3 is pulled towards the chassis 1.

Figure 2:
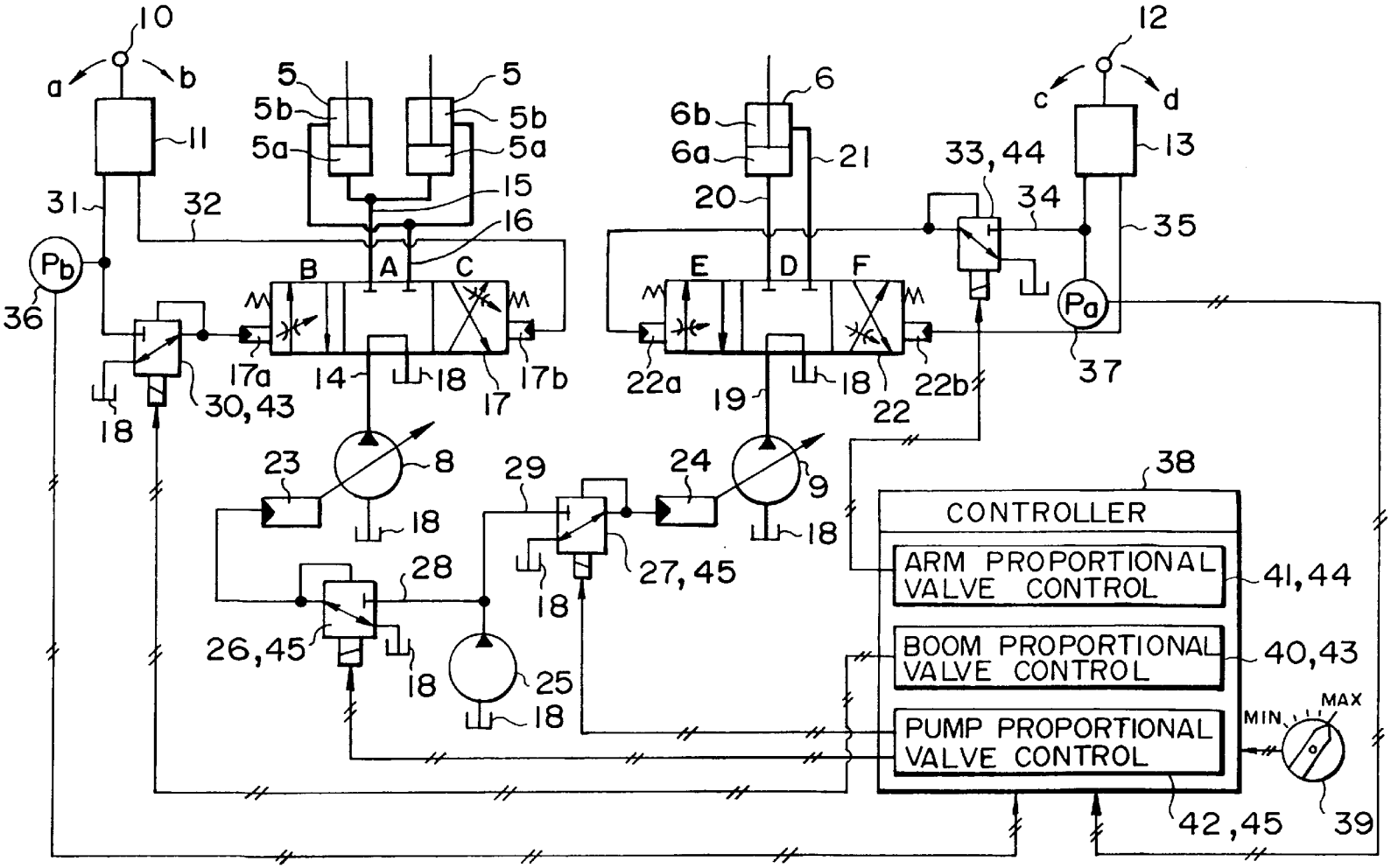
FIG. 2 is a block diagram of a hydraulic control apparatus mounted on the hydraulic excavator as shown in FIG. 1.

The chassis 1 carries a hydraulic control apparatus of the type shown in FIG. 2, for the purpose of controlling the operations of the boom actuating cylinders 5,5 and the arm actuating cylinder 6.

Referring to FIG. 2, the hydraulic control apparatus has a pair of variable displacement hydraulic pumps 8, 9, a remote control valve device 11 having a boom operation lever 10 for operating the boom 2, and a remote control valve device 13 having an arm operation lever 12 for operating the arm 3.

A conduit 14 (working fluid supply passage) leading from the outlet port of the hydraulic pump 8 is connected, through a boom spool valve 17, to a conduit 15 which leads to the bottom-side chambers 5*a*, 5*a* of the boom actuating cylinders 5, 5 and also to a conduit 16 which leads from the rod-side chambers 5*a*, 5*b* of the same cylinders 5, 5. The arrangement is such that working fluid sucked from a working fluid tank 18 is supplied through the boom spool valve 17 to the bottom-side chambers 5*a*, 5*a* and the rod-side chambers 5*b*, 5*b*.

Similarly, a conduit 19 (working fluid supply passage), leading from the outlet port of a hydraulic pump 9 is connected, through an arm spool valve 22, to a conduit 20 leading to the bottom-side chamber 6*a* of the arm actuating cylinder 6 and also to a conduit 21 which leads to the rod-side chamber 6*b* of the cylinder 6. Working fluid sucked from the working fluid tank 18 is supplied to the bottom-side chamber 6*a* or to the rod-side chamber 6*b* of the arm actuating cylinder 6, through the arm spool valve 22.

The hydraulic pumps 8, 9 are variable displacement hydraulic pumps. Thus, displacement rates from these pumps 8, 9 are controllable through control of tilt angle of swash plates performed by regulators 23, 24. The regulators 23, 24 have pilot ports which are connected to the discharge port of a pilot pump 25 which is separate from the hydraulic pumps 8, 9, through pilot conduits 28, 29 which are provided with solenoid proportional valves 26, 27, respectively. Tilt angles of the swash plates in the hydraulic pumps 8, 9 are controlled in accordance with the pilot pressures supplied from the pilot pump 25 via the solenoid proportional valves 26, 27. The delivery pressure of the pilot pump 25, supplied as the primary pressure to each of the solenoid proportional valves 26, 27, is changed into a secondary pressure which is proportional to the electrical current supplied to each solenoid proportional valve. The secondary pressures from the solenoid proportional valves 26, 27 are supplied to the pilot ports of the associated regulators 23, 24. Each of the solenoid proportional valves 26, 27, when not energized, opens its pilot port of the associated regulator 23 or 24 to the working fluid tank 18.

The boom spool valve 17 has a spool (not shown) which is movable to allow the spool valve 17 to be switched over a position A (neutral), a position B and a position C. The boom spool valve 17, when in the neutral position A, blocks the passage between the hydraulic pump 8 and the boom actuating cylinders 5, 5 so as to keep the boom actuating cylinders 5, 5 inoperative. The boom spool valve 17, when in the position B, permits the bottom-side cylinders 5*a*, 5*a* of the boom actuating cylinders 5, 5 to be connected to the hydraulic pump 8, so that the working fluid displaced from the hydraulic pump 8 is supplied into the bottom-side chambers 5*a*, 5*a*, whereby the boom actuating cylinders 5, 5 are operated to extend, with the result that the boom 2 is raised. The boom spool valve 17, when in the position C, permits the rod-side cylinders 5*b*, 5*b* of the boom actuating cylinders 5, 5 to be connected to the hydraulic pump 8, so that the working fluid displaced from the hydraulic pump 8 is supplied into the rod-side chambers 5*b*, 5*b*, whereby the boom actuating cylinders 5, 5 are operated to contract, with the result that the boom 2 is lowered. The boom spool valve 17 is provided with a pair of pilot ports 17*a*, 17*b*, and is held in the neutral position A when no pilot pressure acts in these pilot ports 17*a*, 17*b*. The spool of the boom spool valve 17 is switched to the position B or the position C, when the pilot pressure is supplied to the pilot port 17*a* or the pilot port 17*b*. As a result of this switching of the spool in the boom spool valve 17, the pressurized working fluid from the hydraulic pump 8 is supplied either to the bottom-side chambers 5*a*, 5*a* or to the rod-side chambers 5*b*, 5*b* of the boom actuating cylinders 5, 5, at a rate which corresponds to the level of the pilot pressure supplied to the pilot port 17*a* or 17*b*.

Similarly, the arm spool valve 22 is switchable over three states including a position D (neutral position), a position E and a position F. The arm spool valve 22, when in the neutral position D, blocks the working fluid passage between the hydraulic cylinder 9 and the arm actuating cylinder 6, thereby maintaining the arm actuating cylinder 6 inoperative. The arm spool valve 22, when in position E, connects outlet of the hydraulic pump 9 to the bottom-side chamber 6*a* of the arm actuating cylinder 6, thereby causing the arm actuating cylinder 6 to extend, with the result that the arm 3 is pulled. The arm spool valve 22, when in position F, connects outlet of the hydraulic pump 9 to the rod-side chamber 6*b* of the arm actuating cylinder 6, thereby contracting the arm actuating cylinder 6, with the result that the arm 3 is pushed forward. The arm spool valve 22 has a pair of pilot ports 22*a*, 22*b*, and is held in the neutral position D when no pilot pressure acts in these pilot ports 22*a*, 22*b*. When pilot pressure is supplied to the pilot port 22*a* or 22*b*, the arm spool valve is switched from the position D to the position E or F. When the arm spool valve 22 is in the position E or F, pressurized working fluid is supplied from the hydraulic pump 9 to the bottom-side chamber 6*a* or the rod-side chamber of the arm actuating cylinder 6, at a rate corresponding to the level of the pilot pressure supplied to the pilot port 22*a* or 22*b*.

Figure 3:
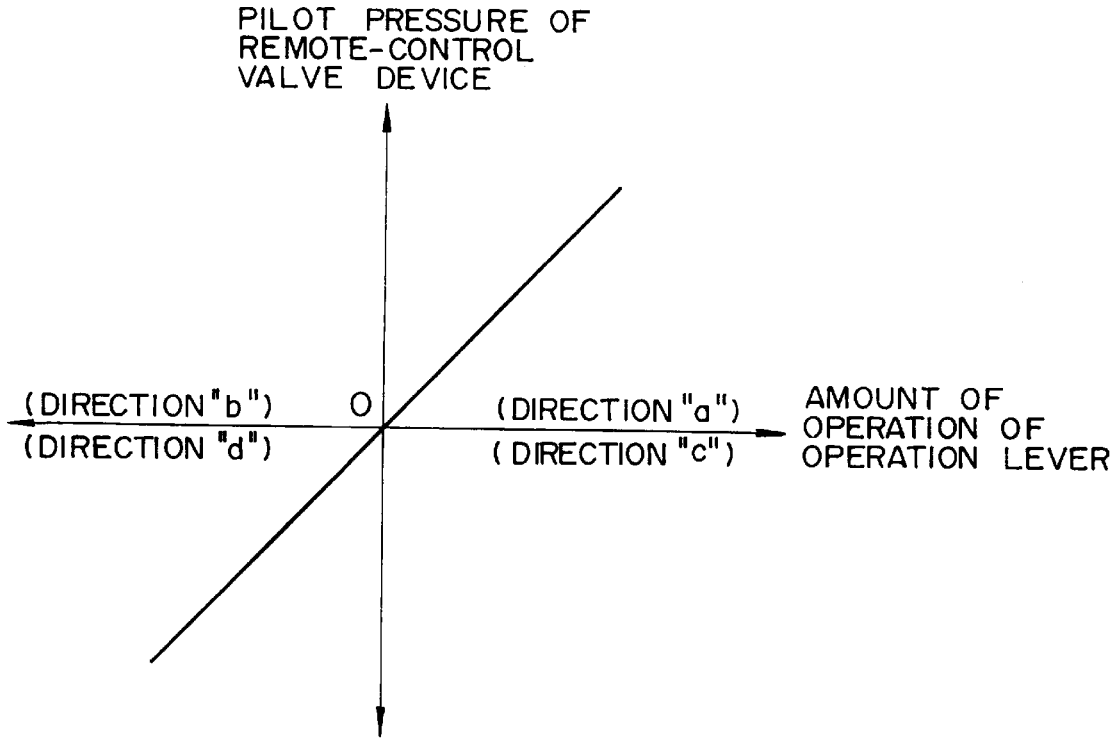
FIG. 3 is a diagram illustrative of the operation of the hydraulic control apparatus shown in FIG. 2.

The remote control valve device 11 produces, in accordance with the direction and amount of operation of the boom operation lever 10, the pilot pressure for operating the boom spool valve 17 in the manner described. The remote control valve device 11 is connected to the pilot port 17*a* of the boom spool valve 17, through a pilot conduit 31 having a solenoid proportional valve 30, and also to the pilot port 17*b* of the same spool valve 17 through a pilot conduit 32. For raising the boom 2, the operator operates the boom operation lever 10 in the direction of the arrow "a". For lowering the boom, the lever 10 is moved in the direction of the arrow "b". An operation of the boom operation lever 10 in the direction for raising the boom 2 (direction "a") as shown in FIG. 3 causes the remote control valve device 11 to produce a pilot pressure corresponding to (proportional to) the amount of operation of the lever 10 in the pilot conduit 31 at the inlet of the solenoid proportional valve 30. Conversely, when the boom operation lever 10 is operated in the direction for lowering the boom 2 (direction "b"), the remote control valve device 11 operates so as to produce, in the pilot conduit 32, a pilot pressure corresponding to (proportional to) the amount of operation of the lever 10.

Similarly, the remote control valve device 13 produces, in accordance with the direction and amount of operation of the arm operation lever 12, the pilot pressure for operating the arm spool valve 22 in the manner described. The remote control valve device 13 is connected to the pilot port 22*a* of the arm spool valve 22, through a pilot conduit 34 having a solenoid proportional valve 33, and also to the pilot port 22*b* of the same spool valve 22 through a pilot conduit 35. For pulling the arm 3 towards the chassis 1, the operator operates the arm operation lever 12 in the direction of the arrow "c".

For pushing the arm 3 forward away from the chassis 1, the lever 12 is moved in the direction of the arrow "d". An operation of the arm operation lever 12 in the direction for pulling the arm 3 (direction "c") causes the remote control valve device 13 to produce a pilot pressure corresponding to (proportional to) the amount of operation of the lever 12 in the pilot conduit 34 upstream of the solenoid proportional valve 33. Conversely, when the arm operation lever 12 is operated in the direction for pushing the arm 3 forward (direction "d"), the remote control valve device 13 operates so as to produce, in the pilot conduit 35, a pilot pressure corresponding to (proportional to) the amount of operation of the lever 13, as will be seen from FIG. 3. The remote control valve devices 11, 13 thus produce pilot pressures in the pilot conduits 41, 34 which are connected to the inlets of the solenoid proportional valves 30, 33 which then produce secondary pressures proportional to the electrical currents supplied thereto. These secondary pressures are supplied to the pilot port 17*a* of the boom spool valve 17 and the pilot port 22*a* of the arm spool valve 22, respectively. The solenoid proportional valves 30, 33, when not energized, open the pilot ports 17*a*, 22*a* of the respective spool valves 17, 22 to the working fluid tank 18.

The remote control valve devices 11 and 13, when the amounts of the operation of the boom operation lever 10 for raising the boom 2 and the amount of operation of the arm operation lever 12 for pulling the arm 3 are equal to each other, produce pilot pressures which are of th e same level.

The hydraulic control apparatus shown in FIG. 2 further comprises the following components: a boom operation pressure sensor 36 serving as boom operation data detecting means which detects the pilot pressure Pb generated by the remote control valve device 11 in accordance with the amount of operation of the boom operation lever 10 in the direction for raising the boom 2; a n arm operation pressure sensor 37 serving as arm operation data detecting means which detects the pilot pressure Pa generated by the remote control valve device 13 in accordance with the amount of operation of the arm operation lever 12 in the direction for pulling the arm 3; a controller 38 for controlling the supply of electrical currents to the solenoid proportional valves 26, 27, 30 and 33; and a gain setting switch 39 for setting, in the controller 38, the gains of the solenoid proportional valves 26, 27, 30, 33, i.e., the rates of changes of the secondary pressures produced by the solenoid proportional valves 26, 27, 30, 33 for given amounts of operations of the operation levers 10, 12. The gain setting switch is switchable over a plurality of stages or positions between "MAX" and "MIN" positions.

The pressure sensors 36 and 37 are connected to the pilot conduits 31 and 34 at the input sides of the solenoid proportional valves 30, 33, and deliver to the controller 38 signals indicative of the pilot pressures Pb and Pa detected in the respective conduits 31, 34.

The controller 38 incorporates a microcomputer and have functional sections including a boom proportional valve control section 40, an arm proportional valve control section 41 and a pump proportional valve control section 42.

Figure 4:
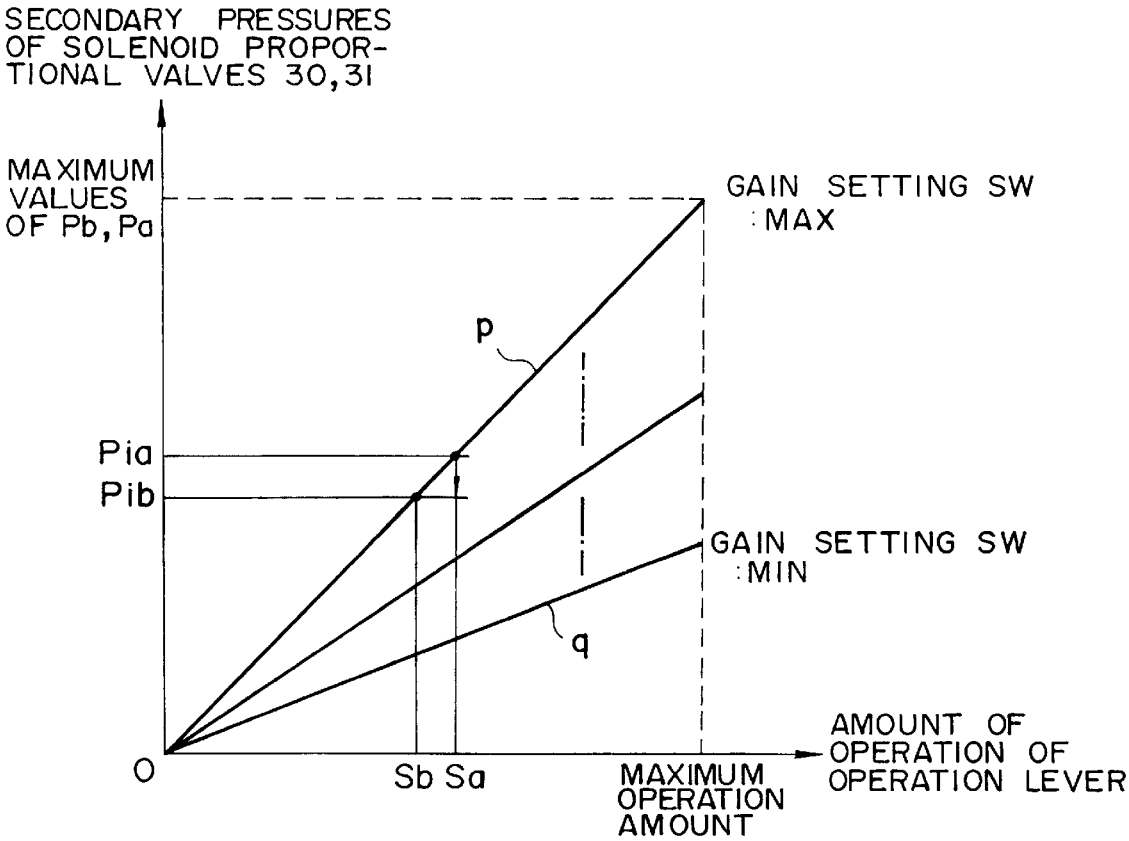
FIG. 4 is another diagram illustrative of the operation of the hydraulic control apparatus shown in FIG. 2.

The boom proportional valve control section 40 and the arm proportional valve control section 41 control the electrical currents to be supplied to the solenoid proportional valve 30 and the solenoid proportional valve 33, respectively. Basically, the boom proportional valve control section 40 and the arm proportional valve control section 41 control the electrical currents to be supplied to the solenoid proportional valves 30, 33 such that, as shown in FIG. 4, these solenoid proportional valves 30, 33 produce secondary pressures which are proportional, respectively, to the amount of the operation of the boom operation lever 10 in the direction for raising the boom 2, indicated by the pilot pressure Pb detected by the pressure sensor 36, and the amount of operation of the arm operation lever 12 for pulling the arm 3, indicated by the pilot pressure Pa detected by the pressure sensor 37. As will be seen from FIG. 4, the secondary pressure gain characteristics of the solenoid proportional valves 30, 31 with respect to the amounts of operation of the operation levers are changeable over a plurality of stages selectable by the gain setting switch 39. For instance, when the gain setting switch 39 has been set to the MAX position, the supply of the electrical currents to the solenoid proportional valves 30, 33 is controlled in accordance with the gradient of the straight line "p" shown in FIG. 4, whereas, when the gain setting switch 39 has been set to the MIN position, the supply of the electrical currents to the solenoid proportional valves 30, 33 is controlled in accordance with the gradient of the straight line "qg" which is smaller than the gradient of the line "p". When the gain setting switch 39 has been set to a position intermediate between the MAX and MIN positions, the gain characteristics are set to selected one of the gradients selectable between the gradients of the lines "p" and "q", and the supply of the electrical currents to the solenoid proportional valves 30, 33 is controlled in accordance with the selected gain characteristics. When the gain characteristic corresponding to the MAX position, i.e., the gradient of the line "p" has been selected, the solenoid proportional valves 30, 33 are so controlled that the pilot pressures Pb, Pa produced by the remote control valve devices 11, 13 are outputted without change as the secondary pressures from the solenoid proportional valves 30, 33. Thus, the pilot pressures Pb, Pa are delivered as they are to the pilot ports 17*a*, 22*a* of the spool valves 17, 22.

The boom proportional valve control section 40 and the arm proportional valve control section 41 perform such a control as to reduce the secondary pressures of the solenoid proportional valves 30, 33 to levels below that is determined by the characteristics shown in FIG. 4, in accordance with the relationship between the levels of the pilot pressures Pb and Pa detected by the pressure sensors 36, 37, when the boom operation lever 10 and the arm operation lever 12 are simultaneously in operation for raising the boom 2 and for pulling the arm 3, respectively, i.e., when the horizontal pulling operation is being performed. Detail of the operation of each of these sections 40 and 41 will be described later.

The pump proportional valve control section 42 controls the supply of electrical currents to the solenoid proportional valves 26, 27 in order to control the rates of displacements of the working fluid from the hydraulic pumps 8, 9. Basically, the pump proportional valve control section 42 performs such a control as to enable the solenoid proportional valves 26, 27 to generate secondary pressures which are to be supplied as pilot pressures to the regulators 23, 24, such that these secondary pressures correspond to the amount of operation of the boom operation lever 10 and the amount of operation of the arm operation lever 12. In other words, the pump proportional valve control section 42 performs such a control that the rates of displacements of the working fluids from the hydraulic pumps 8 and 9 correspond to the amounts of operations of the boom operation lever 10 and the arm operation lever 12, respectively. As in the case of the solenoid proportional valves 30, 33, the gain characteristics of the solenoid proportional valves 26, 27, i.e., the rates of changes of the secondary pressures of these valves 26, 27 and, hence, of the displacement rates of the hydraulic pumps 8,9 with respect to the amounts of operations of the respective levers 10, 12, are changeable over a plurality of stages by means of the gain setting switch 39.

Figure 5:
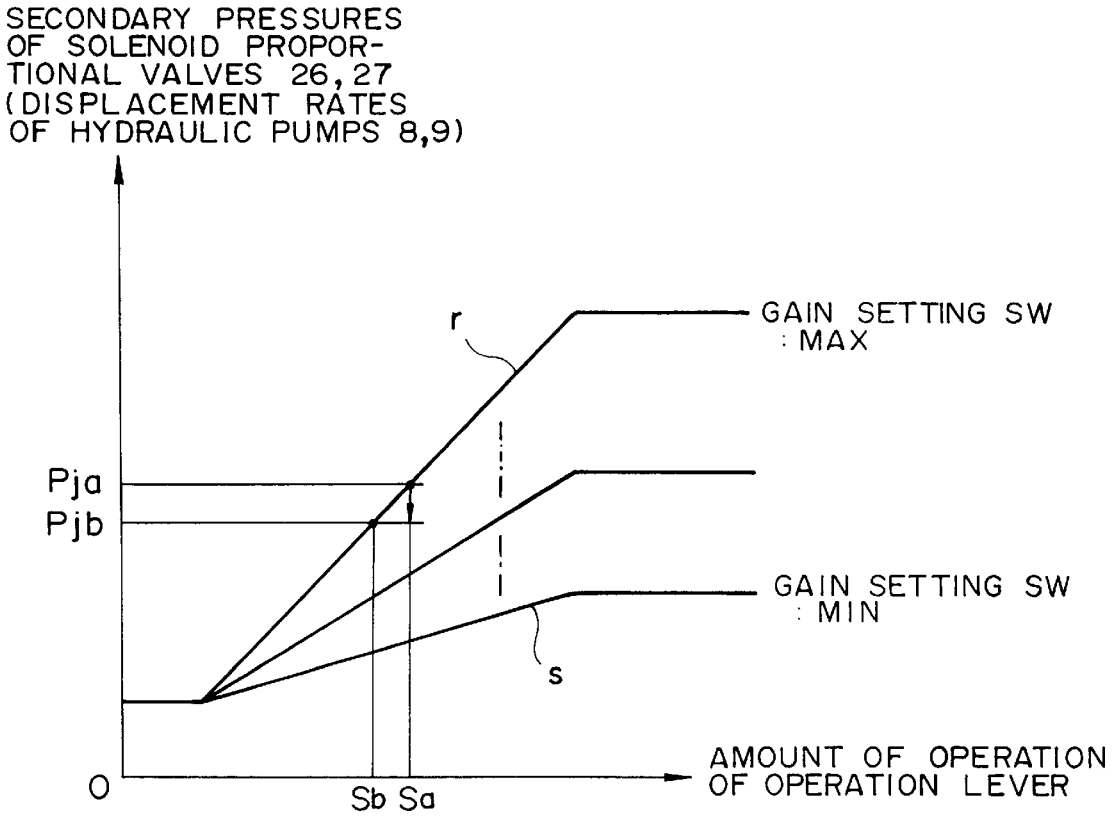
FIG. 5 is still another diagram illustrative of the operation of the hydraulic control apparatus shown in FIG. 2.

Referring to FIG. 5, solid lines "r" and "s" represent the gain characteristics which are obtained when the gain setting switch 39 selects MAX and MIN positions, respectively. The gain characteristic is selectable between the gradients of the lines "r" and "s" as the gain setting switch 39 selects one of the positions or stages between the "MAX" and the "MIN".

The pump proportional valve control section 42 controls the secondary pressures of the solenoid proportional valves 26, 27 in accordance with the gain characteristics set by the gain setting switch 39, such that the secondary pressures of the solenoid proportional valves 26, 27 and, hence, the rates of displacements from the hydraulic pumps 8 and 9, correspond to the amounts of operations of the operation levers 10 and 12.

As in the cases of the boom proportional valve control section 40 and the arm proportional valve control section 41, the arrangement is such that the pump proportional valve control section 42 performs such a control as to reduce the secondary pressures of the solenoid proportional valves 26, 27 to levels below that is determined by the characteristics shown in FIG. 5, in accordance with the relationship between the levels of the pilot pressures Pb and Pa detected by the pressure sensors 36, 37, when the boom operation lever 10 and the arm operation lever 12 are simultaneously in operation for raising the boom 2 and for pulling the arm 3, respectively, i.e., when the horizontal pulling operation is being performed. The detail of this operation will be described later.

The described components of the hydraulic control apparatus provide the following structural features of the invention. The boom proportional valve control section 40 in cooperation with the solenoid proportional valve 30 constitute a boom actuating cylinder retarding means 43, while the arm proportional valve control section 41 in cooperation with the solenoid proportional valve 33 constitutes an arm actuating cylinder retarding means 44. The pump proportional valve control section 42 constitutes a hydraulic pump controlling means 45 in cooperation with the solenoid proportional valves 26, 27.

A description will now be given of the operation, in particular the horizontal pulling operation, performed by the hydraulic excavator in accordance with the present invention, with specific reference to FIG. 6.

For the purpose of conducting horizontal pulling work, the operator first operates the boom and arm operation levers 10, 12 such that the bucket 4 contacts the ground G and then operates the boom operation lever 10 and the arm operation lever 12 in the direction for raising the boom 2 and in the direction for pulling the arm 3. Basically, these levers 10, 12 are operated by almost the same amounts.

Figure 6:
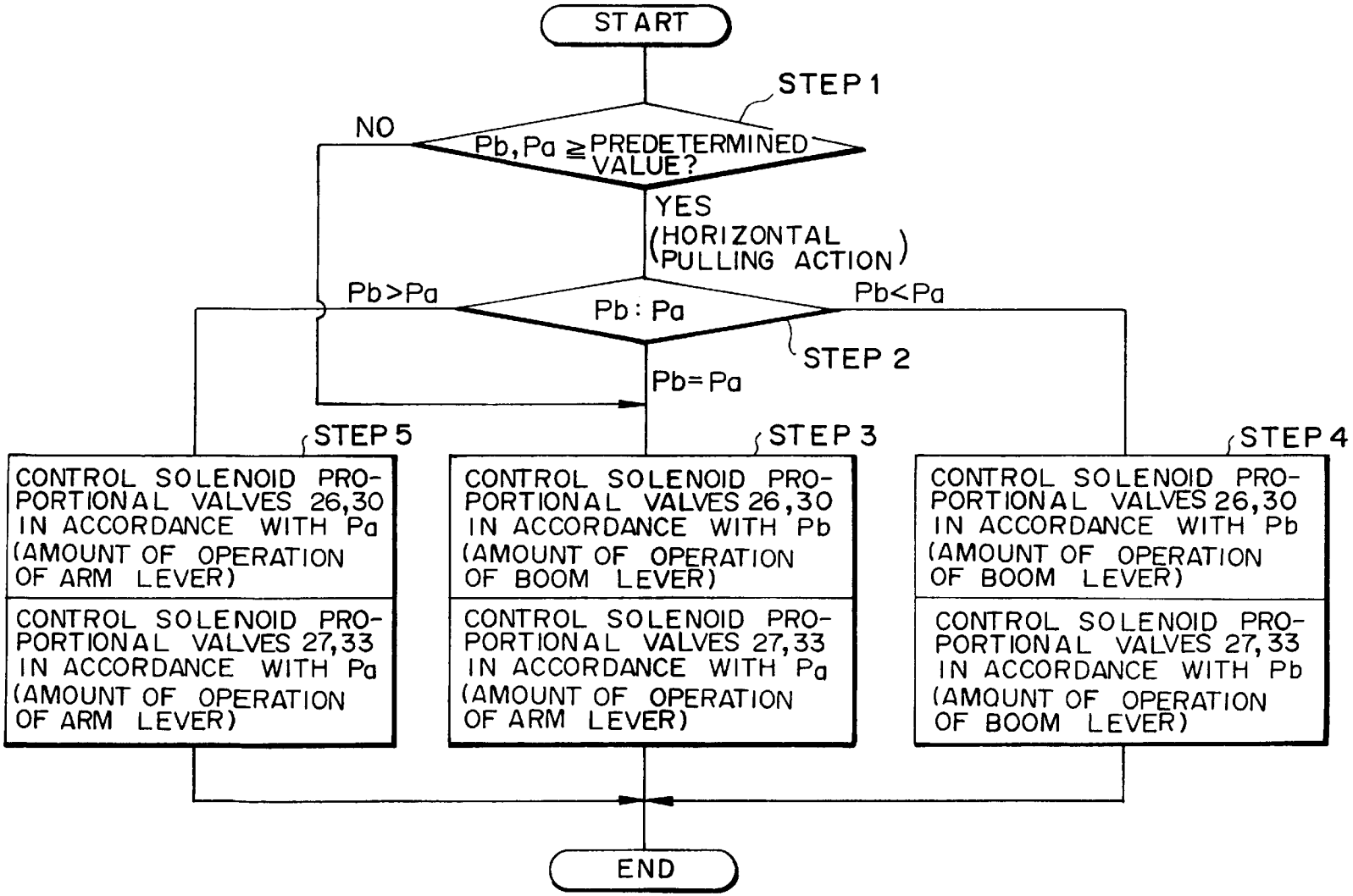
FIG. 6 is a flow chart illustrative of the operation of the hydraulic control apparatus shown in FIG. 2.

As a result of these operations, the controller 38 cyclically conducts a processing of the flow chart shown in FIG. 6, at a regular time interval. STEP 1 determines whether or not the pilot pressures Pb, Pa sensed by the pressure sensors 36, 37 are not less than a predetermined pressure, in order to confirm that the horizontal pulling work is being executed. If the horizontal pulling work is being conducted, the boom operation lever 10 has been operated in the direction for raising the boom 2, while the arm operation lever 12 has been operated in the direction for pulling the arm 3. Therefore, the remote control valve devices 11, 13 produce, in the pilot conduits 31, 34, pilot pressures Pb, Pa of levels not lower than the predetermined pressure. Consequently, an answer YES is given to the question posed in STEP 1, so that the process proceeds to STEP 2 in which the controller 38 performs a comparison between the levels of the pilot pressure Pb and Pa sensed by the pressure sensors 36 and 37, i.e., between the amount of operation of the boom operation lever 10 in the direction for raising the boom 2 and the amount of operation of the arm operation lever 12 in the direction for pulling the arm 3.

When a condition Pb=Pa is confirmed, i.e., if the amount of operation of the boom operation lever 10 and the amount of operation of the arm operation lever 12 are equal to each other, the process proceeds to STEP 3 in which the boom proportional valve control section 40 and the arm proportional valve control section 41 operate in accordance with the gain characteristics (see FIG. 4) selected by the gain setting switch 39 so as to control the supply of the electrical currents to the solenoid proportional valves 30, 33 such that these valves 30, 33 produce secondary pressures which correspond to the amounts of operations of the operation levers 10, 12 and which are used as the pilot pressures Pb, Pa. At the same time, the pump proportional valve control section 42 performs control of the supply of electrical currents to the solenoid proportional valves 26, 27 such that these valves produce secondary pressures corresponding to the amounts of operations of the levers 10, 12.

As a result of the described control of the solenoid proportional valves 30, 33, pilot pressures Pb, Pa of the same level (≦Pb, Pa), corresponding to the amounts of operations of the boom operating lever 10 and the arm operating lever 12 are developed at the pilot ports 17*a* and 22*a* of the boom spool valve 17 and the arm spool valve 22, respectively. Consequently, the spools (not shown) in these spool valves 17 and 22 are shifted to switch these spool valves 17 and 22 to the position "b" and to the position "E", respectively. At the same time, as a result of the controls of the solenoid proportional valves 26, 27 as described above, pilot pressures of levels corresponding to the amount of the boom operation lever 10 and the amount of operation of the arm operation lever 12 are applied to the regulators 23 and 24 of the hydraulic pumps 8 and 9, respectively, whereby the hydraulic pumps 8 and 9 are controlled to displace the working fluids at the rates corresponding to the amounts of operations of the operation levers 10 and 12.

Consequently, the boom actuating cylinders 5, 5 and the arm actuating cylinder 6 are supplied with the working fluid at the rates which corresponds to the amounts of operation of the boom actuating lever 10 and the arm actuating lever 12. Therefore, the boom actuating cylinders 5, 5 and the arm actuating cylinder 6 operate so as to extend and contract, respectively, thereby raising the boom 2 and pulling the arm 3 at speeds corresponding to the amounts of operations of the boom operation lever 10 and the arm operation lever 10. Such operations of the boom actuating cylinder 5,5 and the arm actuating cylinder 6 cause the bucket 4 on the free end of the arm 3 to move horizontally towards the chassis 1, thereby levelling the ground G.

When a condition Pb<Pa is confirmed through the comparison executed in STEP 2, i.e., when the amount of operation of the arm operation lever 12 is greater than the amount of operation of the boom operation lever 10, controlling the solenoid proportional valves 30, 33, 26, 27 in the same manners as those in STEP 3 causes the pilot pressure supplied to the pilot port 22*a* of the arm spool valve 22 to exceed the pilot pressure supplied to the pilot port 17*a* of the boom spool valve 17. As a result, the rate of supply of the working fluid into the bottom-side chamber 6*a* of the arm actuating cylinder 6 via the arm spool valve 22 becomes too large as compared with the rate of supply of the working fluid into the bottom-side chamber 5*a* of each boom actuating cylinder 5 via the boom spool valve 17, with the result that the speed of operation of the arm actuating cylinder 6 for pulling the arm 3 is excessively high as compared with the speed of operation of the boom actuating cylinders 5, 5 for raising the boom 2. Consequently, the bucket 4 is caused to cut into the ground G, thus roughening the levelled ground surface.

In the described embodiment of the hydraulic excavator in accordance with the present invention, the following controls are performed to eliminate the above-described problem when the condition Pb<Pa is detected in STEP 2. Namely, when the condition Pb<Pa is detected, the process proceeds to STEP 4 in which the controller 38 performs such a control that the solenoid proportional valves 30, 26 are controlled by the boom proportional valve control section 40 and the pump proportional valve control section 42, respectively, in the same manner as that in STEP 3 so as to produce a secondary pressure indicated by the pilot pressure Pb corresponding to the amount of operation of the boom operation lever 10, while the arm proportional valve control section 41 controls the solenoid proportional valve 33 such that this valve produces a secondary pressure of the of the level corresponding to the amount of operation of the boom operation lever 10 which is smaller than that of the arm operation lever 12. At the same time, the controller 38 performs such a control as to cause the pump proportional valve control section 42 to control the solenoid proportional valve 27 in such a manner that the solenoid proportional valve 27 produces a secondary pressure indicated by the pilot pressure Pb and corresponding to the amount of operation of the boom operation lever 10.

A more practical description will be given with specific reference to FIG. 4. Assuming that the gain setting switch 39 has been set to the MAX position and that the amounts of operations of the operation levers 10 and 12 are Sb and Sa (Sb<Sa), respectively. The secondary pressures to be produced by the solenoid proportional valves 30 and 33 in accordance with the amounts Sb and Sa of operations of the operation levers 10, 12, i.e., the pilot pressures to be delivered to the pilot ports 17*a* and 22*a*, are indicated by Pib and Pia (Pib<Pia).

In this case, the arm proportional valve control section 41 performs a control as if the amount Sa of operation of the arm operation lever 12 were the same as that Sb of the boom operation lever 10: namely, the arm proportional valve control section 41 conducts the control of the solenoid proportional valve 33 such that the secondary pressure from this valve 33 is reduced from the level Pja which would otherwise be obtained in accordance with the operation amount Sa down to a pressure Pjb corresponding to the operation amount Sb. Such a reducing control is effected by reducing the electrical current supplied to the solenoid proportional valve 33.

Similarly, referring to FIG. 5, the pump proportional valve control section 42 performs as if the amount Sa of operation of the arm operation lever 12 were the same as that Sb of the boom operation lever 10: namely, the pump proportional valve control section 42 conducts the control of the solenoid proportional valve 27 which controls the displacement rate of the hydraulic pump 9, such that the secondary pressure from this valve 27 is reduced from the level Pja which would otherwise be obtained in accordance with the operation amount Sa down to a pressure Pjb corresponding to the operation amount Sb.

As a result, the arm spool valve 22 is driven by a pilot pressure which is smaller than that corresponding to the actual amount of operation of the arm operation lever 12, as if the arm operation lever 12 has been operated by the same amount as the boom operation lever 10, even when the actual amount of operation of the arm operation lever 12 is greater than that of the boom operation lever 10. Consequently, the rate of supply of the working fluid to the bottom-side chamber 6*a* of the arm actuating cylinder 6 is reduced, thus providing an operation speed of the arm actuating cylinder 6 matching with that of the boom actuating cylinders 5, 5 to ensure smooth horizontal pulling work. At the same time, the rate of displacement of the working fluid from the hydraulic pump 9 to the arm actuating cylinder 6 is controlled as if the amount of operation of the arm operation lever 12 were the same as that of the boom operation lever 10, so that the displacement rate matches with the operation speed of the arm actuating cylinder 6, thus ensuring stable behavior of the arm actuating cylinder 6.

Therefore, the horizontal pulling work can be executed smoothly without roughening the levelled ground which otherwise be caused by the bucket cutting into the ground G, even when the arm operation lever 12 has been operated by an amount greater than that of operation of the boom operation lever 10.

A description will now be given of the case where the condition of Pb>Pa is detected in STEP 2 of the flow, i.e., when the amount of operation of the boom operation lever 10 is greater than that of the operation of the arm operation lever 12. In such a case, if the solenoid proportional valves 30, 33, 26 and 27 are controlled in the same manners as those in STEP 3, the pilot pressure supplied to the pilot port 17*a* of the boom spool valve 17 becomes high as compared with the pilot pressure supplied to the pilot port 22*a* of the arm spool valve 22. Consequently, the rate of supply of the working fluid into the bottom-side chamber 5*a* of the boom actuating cylinder 5 via the boom spool valve 17 becomes excessively large as compared with the rate of supply of the working fluid into the bottom-side chamber 6*a* of the arm actuating cylinder 6 via the arm spool valve 22, with the result that the boom actuating cylinders 5, 5 operate too fast in the direction for raising the boom 2 as compared with the speed of operation of the arm actuating cylinder 6 for pulling the arm 3 towards the chassis 1. Consequently, the bucket 4 on the end of the arm 3 floats above the ground G, thus failing to level the ground G.

This problem, however, is avoided in the described hydraulic excavator of the present invention, as will be understood from the following description. When the condition of Pb>Pa is detected in STEP 2, the process proceeds to STEP 5 in which the controller 38 conducts a control which is contrary to the control performed under the condition of Pb<Pa. More specifically, the arm proportional valve control section 41 and the pump proportional control section 42 perform the control of the solenoid proportional valves 33, 27 such that these valves 33, 27 produce secondary pressures corresponding to the amount of operation of the arm operation lever 12, while the boom proportional valve control section 40 controls the solenoid proportional valve 30 such that the valve 30 produces a secondary pressure indicated by the pilot pressure Pa and corresponding to the amount of operation of the arm operation lever 12 which is smaller than the amount of operation of the boom operation lever 10. At the same time, the pump proportional valve control section 42 controls the solenoid proportional valve 26 such that this valve 26 produces a secondary pressure indicated by the pilot pressure Pa and corresponding to the amount of operation of the arm operation lever 12.

As a result, the boom spool valve 17 is driven by a pilot pressure which is smaller than that corresponding to the actual amount of operation of the boom operation lever 12, as if the boom operation lever 10 has been operated by the same amount as the arm operation lever 12, even when the actual amount of operation of the boom operation lever 10 is greater than that of the arm operation lever 12, conversely to the cooperation performed in STEP 4 which is executed under the condition of PB<Pa. Consequently, the rate of supply of the working fluid to the bottom-side chamber 5*a* of each boom actuating cylinder 5 is reduced, thus providing an operation speed of the boom actuating cylinders 5, 5 matching with that of the arm actuating cylinder 6 to ensure smooth horizontal pulling work. At the same time, the rate of displacement of the working fluid from the hydraulic pump 8 to the boom actuating cylinders 5, 5 is controlled as if the amount of operation of the boom operation lever 10 were the same as that of the arm operation lever 12, so that the displacement rate matches with the operation speed of the boom actuating cylinders 5, 5, thus ensuring stable behavior of the boom actuating cylinders 5, 5.

Therefore, the horizontal pulling work can be executed smoothly through elimination of floating of the bucket 4 above the ground G, even when the boom operation lever 10 has been operated by an amount greater than that of operation of the arm operation lever 12.

Thus, in the described embodiment of the hydraulic excavator of the present invention, it is possible to easily conduct the levelling of the ground G by pulling the bucket 4 while keeping it in contact with the ground, provided that the boom operation lever 10 and the arm operation lever 12 are operated by roughly the same amount, without requiring that the amounts of operations of these levers 10, 12 are exactly the same.

In the described embodiment, the gain characteristics of the solenoid proportional valves 26, 27, 30 and 33 are changeable over a plurality of stages by means of the gain setting switch 39, so that the operator can conduct the horizontal pulling work with the gain characteristic selected in accordance with his favor or the conditions of the work. For instance, when the gain setting switch 39 is set to "MAX" position, the operation speeds of the boom actuating cylinders 5, 5 and the arm actuating cylinder 6 are changeable over wide ranges in response to the operations of the operation levers 10 and 12. Conversely, when the gain setting switch 39 is set to the "MIN" position, only small changes in the operation speeds of the boom actuating cylinders 5, 5 and the arm actuating cylinder 6 are caused in response to given changes in the amounts of operations of the boom operation lever 10 and the arm operation lever 12, thus enabling a fine control. It is therefore possible to accurately obtain the desired operation speeds of the respective cylinders.

When either the pilot pressure Pb or the pilot pressure Pa sensed by the pressure sensors 36, 37 in STEP 1 is below a predetermined value, e.g., when the operation for raising the boom 2 alone is conducted or when the operation for pulling the arm 3 alone is conducted, the process skips to STEP 3 in which the solenoid proportional valves 26, 27, 30, 33 are controlled in conformity with the gain characteristics shown in FIGS. 4 and 5 and in accordance with the amounts of operations of the boom operation lever 10 and the arm operation lever 12.

In the foregoing description of the embodiment, the control of operations of the boom actuating cylinders and the arm actuating cylinder is performed in such a manner as to automatically achieve the condition equivalent to the condition of Pa=Pb. This, however, is not exclusive and the control may be performed in such a manner as to realize a condition which is not exactly equivalent to Pa=Pb but to substantially approximate this condition. For instance, STEP 2 of the flow shown in FIG. 6 may be followed by one of the operations shown below:

1) When the condition of Pa−Pb>(predetermined value) is met:

The solenoid proportional valves 26, 30 are operated in accordance with Pb, while the solenoid proportional valves 27, 33 are operated in accordance with Pb+(predetermined value)

2) When the condition of Pb−Pa>(predetermined value) is met:

The solenoid proportional valves 26, 30 are operated in accordance with Pa+(predetermined value), while the solenoid proportional valves 27, 33 are operated in accordance with Pa.

3) When neither the condition 1) nor 2) is met:

The solenoid proportional valves 26, 30 are operated in accordance with Pb, while the solenoid proportional valves 27, 33 are operated in accordance with Pa.

The predetermined value of the condition 1) may be the same as or different from the predetermined value in the condition 2).

Although the control described above relies upon the difference between the pilot pressures Pa and Pb, the control may be performed on the basis of the ratio between the pilot pressure Pa and the pilot pressure Pb, instead of the difference therebetween.

Thus, although the operations of the boom 2 and the arm 3 are ultimately under the control of the operator, an automatic control is performed during the horizontal pulling work such that, when the degree of mismatching or imbalance between the operation speeds of the boom 2 and the arm 3 exceeds a certain level, further increase of the higher one of the operation speeds is suppressed, thereby preventing the bucket from cutting into the ground or floating above the ground. It is also to be noted that the limitation of the operation speed is imposed on either one of the boom and arm, instead of limiting the operation speeds of both the boom and the arm.

With specific reference to FIG. 7, a description will now be given of a second embodiment of the present invention which is based on the first embodiment described before. In the following description taken in conjunction with FIG. 7, the same reference numerals as those used in the description of the first embodiment are used to denote the parts or components used in the second embodiment which are the same as or equivalent to those used in the first embodiment, and detailed description of such components or parts is omitted.

Figure 7:
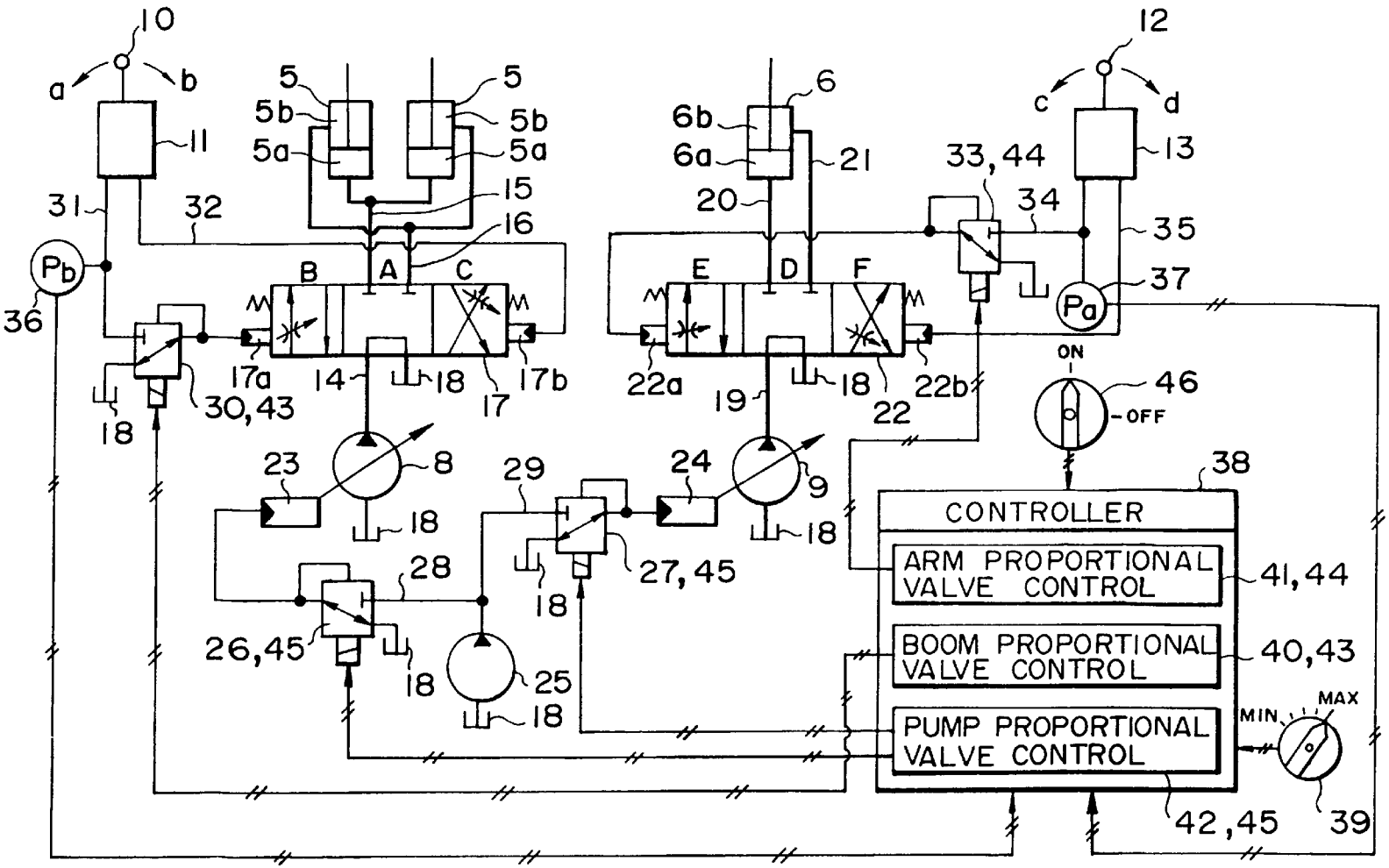
FIG. 7 is a block diagram showing the construction of a hydraulic control apparatus in accordance with a second embodiment, for use on the hydraulic excavator shown in FIG. 1.

Referring to FIG. 7, the second embodiment is different from the first embodiment in that the second embodiment employs an operation switch 46 which serves as prohibiting means for selectively enabling or disabling the controller 38 in accordance with the operator's intention, thus selectively prohibiting the control operation of the first embodiment during the horizontal pulling work. Other features are the same as those of the first embodiment. When the operation switch 46 is turned ON, the controller 38 is enabled to conduct the control for the horizontal pulling work, whereas, when the switch 46 is turned OFF, the controller 38 is informed that the control should not be conducted (prohibited).

The operation of the hydraulic excavator in accordance with the second embodiment is the same as that of the first embodiment, insofar as the operation switch 46 is ON. However, when the operation switch 46 is OFF, the controller 38 performs the control of STEP 3 in the flow shown in FIG. 6, regardless of the relationship between the pilot pressures Pb, Pa obtained from the pressure sensors 36, 37, i.e., independently of the relationship between the amount of operation of the boom operation lever 10 for raising the boom 2 and the amount of operation of the arm operation lever 12 for pulling the arm 3.

As a consequence, the control for reducing the pilot pressure to the boom spool valve 17 or the arm spool valve 22, i.e., the control for reducing the rate of supply of the working fluid to the boom actuating cylinders 5, 5 or the arm actuating cylinder 6, as well as the control for reducing the displacement rate from the hydraulic pump 8 or the hydraulic pump 9, is dismissed, so that the spool valves 17 and 22 are driven by the pilot pressures the levels of which corresponds to the actual amounts of operations of the levers 10 and 12. At the same time, the displacement rates from the hydraulic pumps are controlled in accordance with the amounts of operations of the operation levers 10 and 12. Consequently, the boom actuating cylinders 5, 5 and the arm actuating cylinder 6 operate at speeds which correspond to the amounts of operations of the operation levers 10 and 12.

When the operator wishes to conduct a work which is other than horizontal pulling work and which also require simultaneous boom raising and arm pulling operations, he can dismiss the horizontal pulling control mode by turning the operation switch OFF so that he can operate the boom actuating cylinders 5,5 and the arm actuating cylinder 6 in normal operation mode to conduct the work.

Although the hydraulic excavators of the first and second embodiments employ variable displacement hydraulic pumps as the pumps 8 and 9, it will be clear that the invention can equally be carried out by using constant displacement hydraulic pumps as the hydraulic pumps which deliver the pressurized working fluid to the boom actuating cylinders 5, 5 and the arm actuating cylinder 6. When constant displacement hydraulic pumps are used, the described control in the horizontal pulling work, which is performed in the first embodiment unconditionally and performed in the second embodiment on condition that the operation switch 46 is ON, is implemented by controlling the pilot pressures supplied to the boom spool valve 17 and the arm spool valve 22 in the same manner as the first and second embodiments.

In each of the first and second embodiments as described, the control has two phases: namely, a first phase in which, on condition that the amount of operation of the boom operation lever 10 is greater than the amount of operation of the arm operation lever 12 (Pb>Pa), a control is performed to reduce the pilot pressure to be supplied to the boom spool valve 17, as well as a control for reducing the rate of displacement of the fluid from the hydraulic pump 8; and a second phase in which, on condition that the amount of operation of the arm operation lever 12 is greater than the amount of operation of the boom operation lever 10 (Pa>Pb), a control is performed to reduce the pilot pressure to be supplied to the arm spool valve 22, as well as a control for reducing the rate of displacement of the fluid from the hydraulic pump 9. However, when prevention of the bucket 4 from cutting into the ground alone is a matter of concern, the invention may be carried out by employing only the second phase of the control, while omitting the first phase of the control. In such a case, when the amount of operation of the arm operation lever 12 is greater than the amount of operation of the boom operation lever 10 (Pa>Pb), the control is performed to reduce the pilot pressure to be supplied to the arm spool valve 22, as well as the control for reducing the rate of displacement of the fluid from the hydraulic pump 9, in the same manner as that in the first embodiment. However, when the amount of operation of the boom operation lever 10 is greater than the amount of operation of the arm lever, the control for reducing the level of the pilot pressure to be applied to the boom spool valve 17 and the control for reducing the displacement rate from the hydraulic pump 8 are not executed unlike the described embodiments. Thus, the pilot pressure to be applied to the boom spool valve 17 and the displacement rate from the hydraulic pump 8 are changed in accordance with the amount of operation of the boom operation lever 10.

Conversely, when prevention of floating of the bucket 4 above the ground alone is a matter of concern, the invention may be carried out by employing only the first phase of the control, while omitting the second phase of the control. In such a case, when the amount of operation of the boom operation lever 10 is greater than the amount of operation of the arm operation lever 12 (Pa<Pb), the control is performed to reduce the pilot pressure to be supplied to the boom spool valve 17, as well as the control for reducing the rate of displacement of the fluid from the hydraulic pump 9, in the same manner as that in the first embodiment. However, when the amount of operation of the arm operation lever 12 is greater than the amount of operation of the boom operation lever 10, the control for reducing the level of the pilot pressure to be applied to the boom spool valve 22 and the control for reducing the displacement rate from the hydraulic pump 9 are not executed unlike the described embodiments. Thus, the pilot pressure to be applied to the arm spool valve 22 and the displacement rate from the hydraulic pump 9 are changed in accordance with the amount of operation of the arm operation lever 12.

The hydraulic excavator of the described embodiments also may be modified such that, in order to prevent floating of the bucket 4 during the horizontal pulling work, only the control for reducing the displacement rate from the hydraulic pump 8 is executed, without executing the control for reducing the pilot pressure to be supplied to the boom spool valve 17, when the amount of operation of the boom operation lever 10 is greater than that of the arm operation lever 12. In such a modification, when the amount of operation of the boom operation lever 10 is greater than the amount of operation of the arm operation lever 12, the rate of displacement of the working fluid from the hydraulic pump 8 is reduced down below the level set by the boom spool valve 17 which corresponds to the amount of operation of the boom operation lever 10. As a result, the boom 2 tends to be lowered due to its weight, thus preventing the bucket 4 from floating above the ground G. This modified hydraulic excavator may have an operation switch for prohibiting the control, similar to the operation switch 46 used in the second embodiment. In such a case, the control for reducing the displacement rate from the hydraulic pump 8 is prohibited when the switch is turned OFF.

In the first and second embodiments as described, the pressure sensors 36, 37 serve as the boom operation data detecting means and the arm operation data detecting means, and the control for the horizontal pulling work is conducted in accordance with the pilot pressures sensed by the pressure sensors 36, 37. The use of such pressure sensors, however, is not exclusive and the arrangement may be such that the amounts of operations of the boom operation lever 10 and the arm operation lever 12 are directly detected by means of, for example, potentiometers, so that the control for the horizontal pulling work is executed based on the detected operation amounts of the lever. In such an arrangement, the detected values of the amounts of operations of the operation levers 10, 12 are delivered to the controller 38, instead of the pressures sensed by the pressure sensors 36, 37.

In the first and second embodiments, the operation speeds of the boom actuating cylinders 5,5 and the arm actuating cylinder 6 are controlled during the horizontal pulling work such that these speeds match with each other, as a result of supply of the same pilot pressure both to the boom spool valve 17 and the arm spool valve 22. In this case, the ratio between the pilot pressures is 1:1. This manner of control, however, is not exclusive. For instance, the arrangement may be such that the operation speeds of the boom actuating cylinders 5,5 and the arm actuating cylinder 6 are controlled matching each other, with different levels of pilot pressure applied to the boom spool valve 17 and the arm spool valve 22, e.g., a pilot pressure ratio of 2:1, when the boom operation lever 10 and the arm operation lever 12 are operated by the same amount in the boom raising direction and in the arm pulling direction, respectively. More specifically, the arrangement may be such that, when the boom operation lever 10 and the arm operation lever are operated by the same amount, the boom spool valve 17 is supplied with a pilot pressure which is twice as high the pilot pressure applied to the arm spool valve 22. In operation, when the pressure Pa sensed by the pressure sensor 37 is greater than ½ of the pressure Pb sensed by the pressure sensor 36, the pilot pressure supplied to the arm spool valve 22 is reduced to the level corresponding to the amount of operation of the boom operation lever 10 (the pressure level being Pb/2 when the gain setting switch 39 has been set to MAX) and the displacement rate from the hydraulic pump 9 is reduced to a rate which corresponds to the amount of operation of the boom operation lever 10, thus preventing the bucket 4 from cutting into the ground G. Conversely, when the pressure Pb sensed by the pressure sensor 36 exceeds a pressure which is twice as high the pressure Pa sensed by the pressure sensor 37, the pilot pressure supplied to the boom spool valve 17 is reduced to a level corresponding to the amount of operation of the arm operation lever 12 (this pressure level being 2Pa when the gain setting switch has been set to MIN.) and, at the same time, the displacement rate from the hydraulic pump 8 is reduced to a rate which corresponds to the amount of operation of the arm operation lever 12, whereby the bucket 4 is prevented from floating above the ground G.

A third embodiment of the present invention will be described with reference to FIGS. 8 to 11. The basic structure of the hydraulic excavator in accordance with the third embodiment is the same as those of the preceding embodiments and, therefore, description of the basic structure is omitted.

Figure 8:
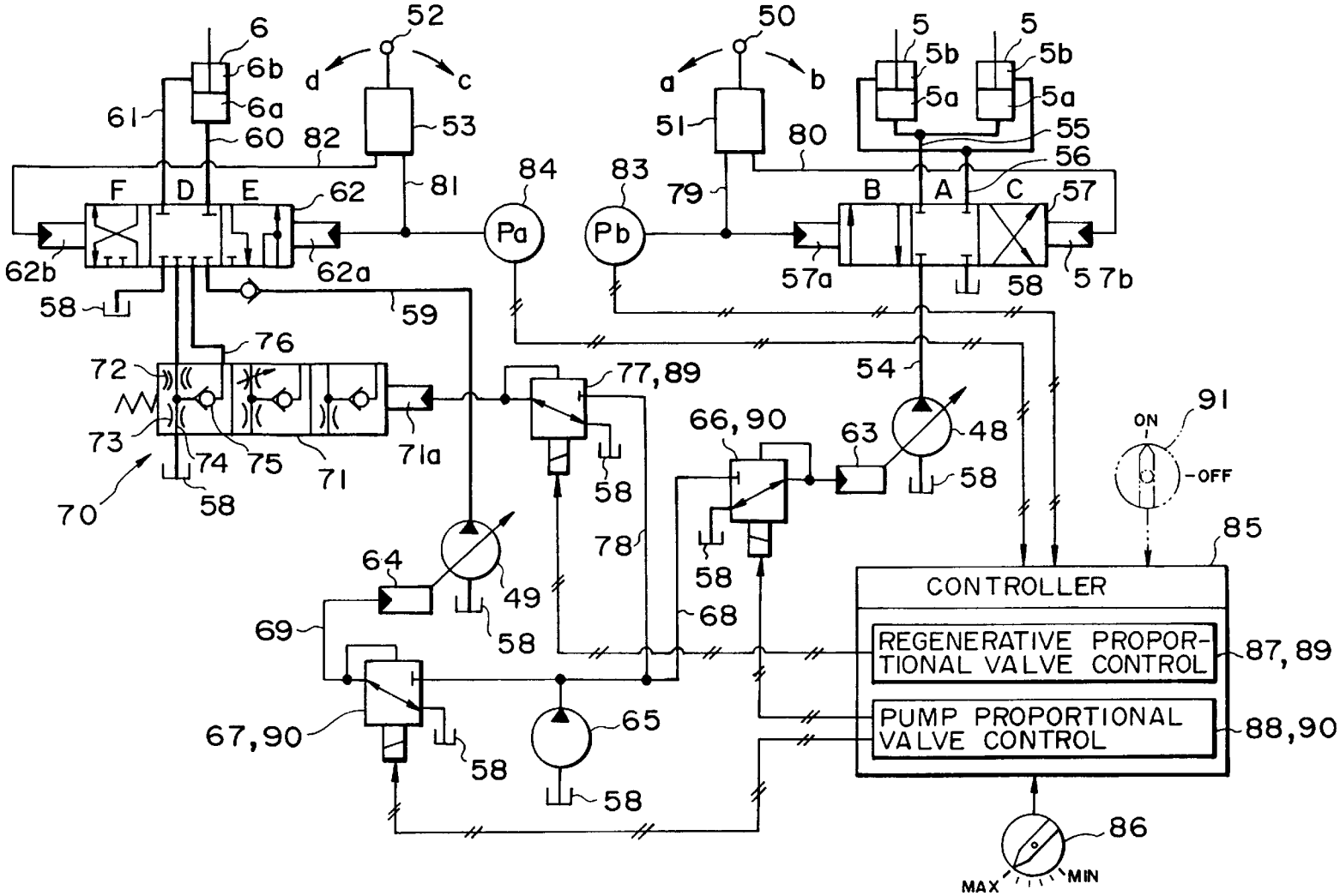
FIG. 8 is a block diagram showing the construction of a hydraulic control apparatus in accordance with a third embodiment, for use on the hydraulic excavator shown in FIG. 1.

The hydraulic excavator of this embodiment has a chassis 1 which carries boom actuating cylinders 5, 5, an arm actuating cylinder 6 and a hydraulic control apparatus which controls the operations of these cylinders and which is generally shown in FIG. 8.

Referring to FIG. 8, the hydraulic control apparatus has a pair of variable displacement hydraulic pumps 48, 49, a remote control valve device 51 having a boom operation lever 50 for operating the boom 2, and a remote control valve device 53 having an arm operation lever 52 for operating the arm 3.

A conduit 54 (working fluid supply passage) leading from the outlet port of a hydraulic pump 48 is connected, through a boom spool valve 57, to a conduit 55 which leads to the bottom-side chambers 5*a*, 5*a* of the boom actuating cylinders 5, 5 and also to a conduit 56 which leads from the rod-side chambers 5*b*, 5*b* of the same cylinders 5, 5. The arrangement is such that working fluid sucked from a working fluid tank 58 is supplied through the boom spool valve 57 to the bottom-side chambers 5*a*, 5*a* and the rod-side chambers 5*b*, 5*b*.

Similarly, a conduit 59 (working fluid supply passage), leading from the outlet port of a hydraulic pump 49 is connected, through an arm spool valve 62, to a conduit 60 leading to the bottom-side chamber 6*a* of the arm actuating cylinder 6 and also to a conduit 61 which leads to the rod-side chamber 6*b* of the cylinder 6. Working fluid sucked from the working fluid tank 48 is supplied to the bottom-side chamber 6*a* or to the rod-side chamber 6*b* of the arm actuating cylinder 6, through the arm spool valve 62.

The hydraulic pumps 48, 49 are variable displacement hydraulic pumps. Thus, displacement rates from these pumps 48, 49 are controllable through control of tilt angle of swash plates performed by regulators 63, 64. The regulators 63, 64 have pilot ports which are connected to the discharge port of a pilot pump 65 which is separate from the hydraulic pumps 48, 49, through pilot conduits 68, 69 which are provided with solenoid proportional valves 66, 67, respectively. Tilt angles of the swash plates in the hydraulic pumps 68, 69 are controlled in accordance with the pilot pressures supplied from the pilot pump 65 via the solenoid proportional valves 66, 67. The delivery pressure of the pilot pump 65, supplied as the primary pressure to each of the solenoid proportional valves 66, 67, is changed into a secondary pressure which is proportional to the electrical current supplied to each solenoid proportional valve. The secondary pressures from the solenoid proportional valves 66, 67 are supplied to the pilot ports of the associated regulators 63, 64. Each of the solenoid proportional valves 66, 67, when not energized, opens its pilot port of the associated regulator 63 or 64 to the working fluid tank 58.

The boom spool valve 57 has a spool (not shown) which is movable to allow the spool valve 57 to be switched over a position A (neutral), a position B and a position C. The boom spool valve 57, when in the neutral position A, blocks the passage between the hydraulic pump 48 and the boom actuating cylinders 5, 5 so as to keep the boom actuating cylinders 5, 5 inoperative. The boom spool valve 57, when in the position B, permits the bottom-side cylinders 5*a*, 5*a* of the boom actuating cylinders 5, 5 to be connected to the hydraulic pump 48, so that the working fluid displaced from the hydraulic pump 48 is supplied into the bottom-side chambers 5*a*, 5*a*, whereby the boom actuating cylinders 5, 5 are operated to extend, with the result that the boom 2 is raised. The boom spool valve 57, when in the position C, permits the rod-side cylinders 5*b*, 5*b* of the boom actuating cylinders 5, 5 to be connected to the hydraulic pump 48, so that the working fluid displaced from the hydraulic pump 48 is supplied into the rod-side chambers 5*b*, 5*b*, whereby the boom actuating cylinders 5, 5 are operated to contract, with the result that the boom 2 is lowered. The boom spool valve 57 is provided with a pair of pilot ports 57*a*, 57*b*, and is held in the neutral position A when no pilot pressure acts in these pilot ports 57*a*, 57*b*. The spool of the boom spool valve 57 is switched to the position B or the position C, when the pilot pressure is supplied to the pilot port 57*a* or the pilot port 57*b*. As a result of this switching of the spool in the boom spool valve 57, the pressurized working fluid from the hydraulic pump 48 is supplied either to the bottom-side chambers 5*a*, 5*a* or to the rod-side chambers 5*b*, 5*b* of the boom actuating cylinders 5, 5, at a rate which corresponds to the level of the pilot pressure supplied to the pilot port 57*a* or 57*b*.

Similarly, the arm spool valve 62 is switchable over three states including a position D (neutral position), a position E and a position F. The arm spool valve 62, when in the neutral position D, blocks the working fluid passage between the hydraulic cylinder 49 and the arm actuating cylinder 6, thereby maintaining the arm actuating cylinder 6 inoperative. The arm spool valve 62, when in position E, connects outlet of the hydraulic pump 49 to the bottom-side chamber 6*a* of the arm actuating cylinder 6, thereby extending the arm actuating cylinder 6, with the result that the arm 3 is pulled. The arm spool valve 62, when in position F, connects outlet of the hydraulic pump 49 to the rod-side chamber 6*b* of the arm actuating cylinder 6, thereby contracting the arm actuating cylinder 6, with the result that the arm 3 is pushed forward. The arm spool valve 62 has a pair of pilot ports 62*a*, 62*b*, and, when pilot pressure is supplied to the pilot port 62*a* or 62*b*, the arm spool valve is switched from the position D to the position E or F. When the arm spool valve 62 is in the position E or F, pressurized working fluid is supplied from the hydraulic pump 49 to the bottom-side chamber 6*a* or the rod-side chamber 6*b* of the arm actuating cylinder 6, at a rate corresponding to the level of the pilot pressure supplied to the pilot port 62*a* or 62*b*.

The arm spool valve 62, when in the position E, provides communication between the rod-side chamber 6*b* of the arm cylinder 6 with a returning circuit 70 which will now be described.

The returning circuit 70 comprises a returning spool valve 71 which has two fluid passages: namely, a fluid passage 74 which, when the arm spool valve 62 is in its position E, allows the rod-side chamber 6*b* of the arm actuating cylinder 6 to communicate with the working fluid tank 58 successively though a variable orifice 72 having a variable passage area and a fixed orifice 73 of a constant passage area; and a fluid passage 76 which leads, through a check valve 75, from a portion of the first-mentioned passage 74 between the orifices 72, 73 to the bottom-side chamber 6*a* of the arm actuating cylinder 6 via the arm spool valve 62 which is set in the position E. Therefore, when the arm spool valve 62 is in the position E, part of the working fluid displaced from the rod-side chamber 6*b* of the arm actuating cylinder 6 is relieved to the working fluid tank 58 via the fluid passage 74, while the remainder of the fluid returns to the bottom-side chamber 6*a* of the arm actuating cylinder 6 via the variable orifice 72, check valve 75*a* and through the fluid passage 76.

The variable orifice 72 of the return spool valve 71 linearly changes the area of the fluid passage defined therein, as a result of displacement of a spool (not shown) corresponding to the pilot pressure supplied to the pilot pressure port 71*a* of the return spool valve 71. More specifically, the area of the fluid passage in the variable orifice 72 is minimum when no pressure is applied to the pilot port 71*a*. The passage area in the variable orifice 72 is linearly increased in accordance with a rise of the pilot pressure, up to the maximum area which, in this embodiment, equals to the non-restricted passage area.

The pilot port 71*a* of the return spool valve 71 is connected to the outlet port of the pilot pump 65 through a pilot conduit 78 having a solenoid proportional valve 77. The solenoid proportional valve 77 supplied with fluid pressure from the pilot pump 65 produces the pilot pressure in accordance with which the passage area in the variable orifice 72 is controlled. As are the cases of the solenoid proportional valves 66, 67, the solenoid proportional valve 77 produces, upon being supplied with the pressure from the pilot pump 65, a secondary pressure which is proportional to the electrical current supplied thereto. The secondary pressure thus produced is delivered as the pilot pressure to the pilot port 71*a* of the return spool valve 71. The solenoid proportional valve 77, when not energized, opens the pilot port 71*a* to the working fluid tank 58.

The remote control valve device 51 produces, in accordance with the direction and amount of operation of the boom operation lever 50, the pilot pressure for operating the boom spool valve 57 in the manner described. The remote control valve device 51 is connected to the pilot port 57*a* of the boom spool valve 57, through a pilot conduit 79 and also to the pilot port 57*b* of the same spool valve 57 through a pilot conduit 80. For raising the boom 2, the operator operates the boom operation lever 50 in the direction of the arrow "aa". For lowering the boom, the lever 50 is moved in the direction of the arrow "b". An operation of the boom operation lever 50 in the direction for raising the boom 2 (direction "a") as shown in FIG. 8 causes the remote control valve device 51 to produce a pilot pressure corresponding to (proportional to) the amount of operation of the lever 50 in the pilot conduit 79. Conversely, when the boom operation lever 10 is operated in the direction for lowering the boom 2 (direction "b"), the remote control valve device 51 operates so as to produce, in the pilot conduit 80, a pilot pressure corresponding to (proportional to) the amount of operation of the lever 50.

Similarly, the remote control valve device 53 produces, in accordance with the direction and amount of operation of the arm operation lever 52, the pilot pressure for operating the arm spool valve 62, in accordance with the direction and amount of the lever operation. The remote control valve device 53 is connected to the pilot port 62*a* of the arm spool valve 62, through a pilot conduit 81, and also to the pilot port 62*b* of the same spool valve 62 through a pilot conduit 82. For pulling the arm 3 towards the chassis 1, the operator operates the arm operation lever 52 in the direction of the arrow "c".

For pushing the arm 3 forward away from the chassis 1, the lever 52 is moved in the direction of the arrow "d". An operation of the arm operation lever 52 in the direction for pulling the arm 3 (direction "c") causes the remote control valve device 53 to produce a pilot pressure corresponding to (proportional to) the amount of operation of the lever 52 in the pilot conduit 81. Conversely, when the arm operation lever 52 is operated in the direction for pushing the arm 3 forward (direction "d"), the remote control valve device 53 operates so as to produce, in the pilot conduit 82, a pilot pressure corresponding to (proportional to) the amount of operation of the lever 52.

The remote control valve devices 51, 53 thus produce pilot pressures of the same level, when the amount of operation of the boom operation lever 50 in the direction for raising the boom 2 and the amount of operation of the boom operation lever 52 in the direction for pulling the arm 3 are the same.

The hydraulic control apparatus shown in FIG. 8 further comprises the following components: a boom operation pressure sensor 83 which detects the pilot pressure Pb generated by the remote control valve device 51 in accordance with the amount of operation of the boom operation lever 50 in the direction for raising the boom 2; an arm oper ation pressure sensor 84 which detects the pilot pressure Pa generated by the remote control valve device 53 in accordance with the amount of operation of the arm operation lever 52 in the direction for pulling the arm 3; a controller 85 for controlling the supply of electrical currents to the solenoid proportional valves 66, 67 and 77; and a gain setting switch 86 for setting, in the controller 85, the gains of the solenoid proportional valves 66, 67 and 77, i.e., the rates of changes of the secondary pressures produced by the solenoid proportional valves for given amounts of operations of the operation levers 50, 52. The gain setting switch 86 constitutes the pump gain setting means and the variable orifice gain setting means, and is switchable over a plurality of stages or positions between "MAX" and "MIN" positions.

The pressure sensors 83 and 84 are connected to the pilot conduits 79 and 81 and deliver to the controller 85 signals indicative of the pilot pressures Pb and Pa detected in the respective conduits 79, 81.

The controller 85 incorporates a microcomputer and have functional sections including a return proportional valve control section 87,and a pump proportional valve control section 88.

Figure 9:
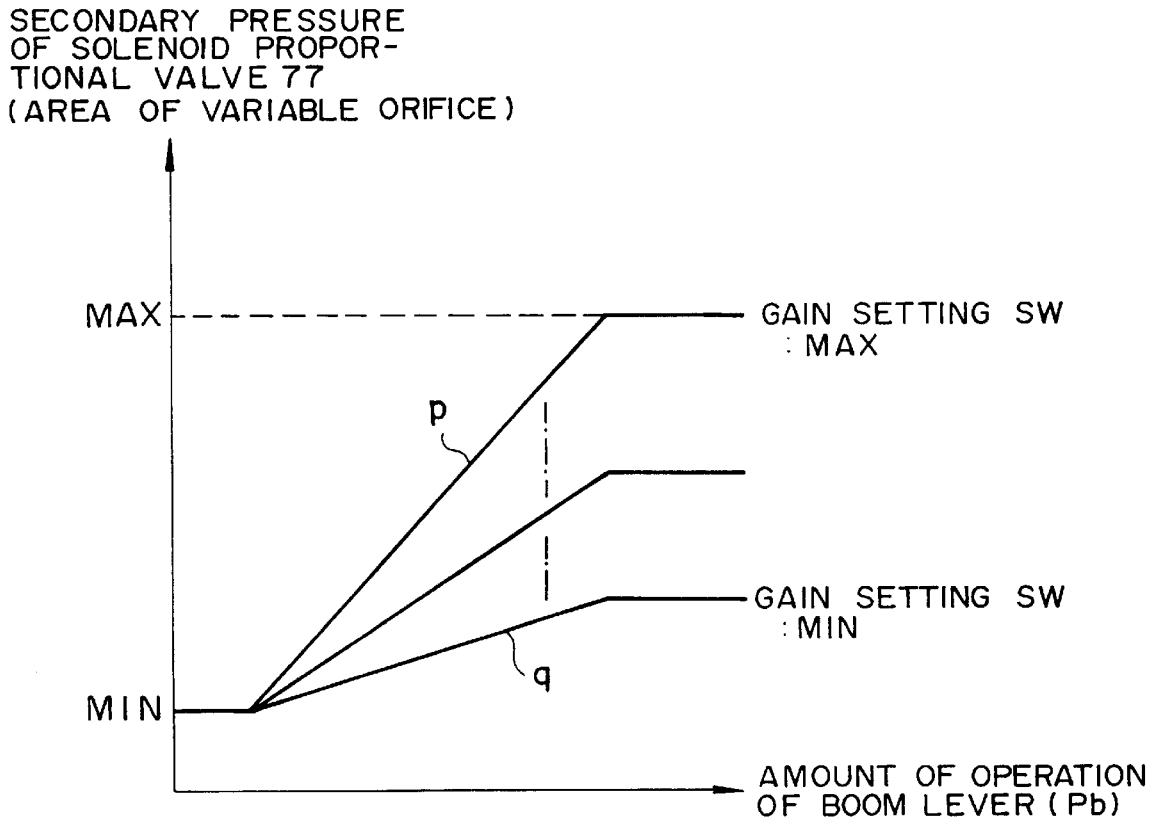
FIG. 9 is a diagram illustrative of the hydraulic control apparatus shown in FIG. 8.

The return proportional valve control section 87 controls the electrical current to be supplied to the solenoid proportional valve 77. Basically, the return proportional valve control section 87 controls the electrical current to be supplied to the solenoid proportional valve 77 such that, as shown in FIG. 9, the solenoid proportional valve 77 produce secondary pressure which is proportional to the amount of the operation of the boom operation lever 50 in the direction for raising the boom 2, indicated by the pilot pressure Pb detected by the pressure sensor 83. As will be seen from FIG. 9, the secondary pressure gain characteristics of the solenoid proportional valve 77 (gain characteristic of the passage area of variable orifice 72 of the return spool valve 71) with respect to the amount of operation of the boom operation lever 50 are changeable over a plurality of stages selectable by the gain setting switch 86. For instance, when the gain setting switch 86 has been set to the MAX position, the supply of the electrical current to the solenoid proportional valve 77 is controlled in accordance with the gradient of the straight line "p" shown in FIG. 9, whereas, when the gain setting switch 86 has been set to the MIN position, the supply of the electrical current to the solenoid proportional valve 77 is controlled in accordance with the gradient of the straight line "q" which is smaller than the gradient of the line "p". When the gain setting switch 86 has been set to a position intermediate between the MAX and MIN positions, the gain characteristics are set to selected one of the gradients selectable between the gradients of the lines "p" and "q", and the supply of the electrical current to the solenoid proportional valve 77 is controlled in accordance with the selected gain characteristics.

The return proportional valve control section 87 performs the control of the electrical current supplied to the solenoid proportional valve 77 when the boom operation lever 50 and the arm operation lever 52 are simultaneously in operation for raising the boom 2 and for pulling the arm 3, respectively, i.e., when the horizontal pulling operation is being performed. In other situations, e.g., when the arm operation lever 52 alone is being operated, the return proportional valve control section 87 controls the electrical current supplied to the solenoid proportional valve 77 such that the secondary pressure of the solenoid proportional valve is maximized, i.e., in such a manner as to maximize the passage area of the variable orifice 72 in the return spool valve 71.

Figure 10:
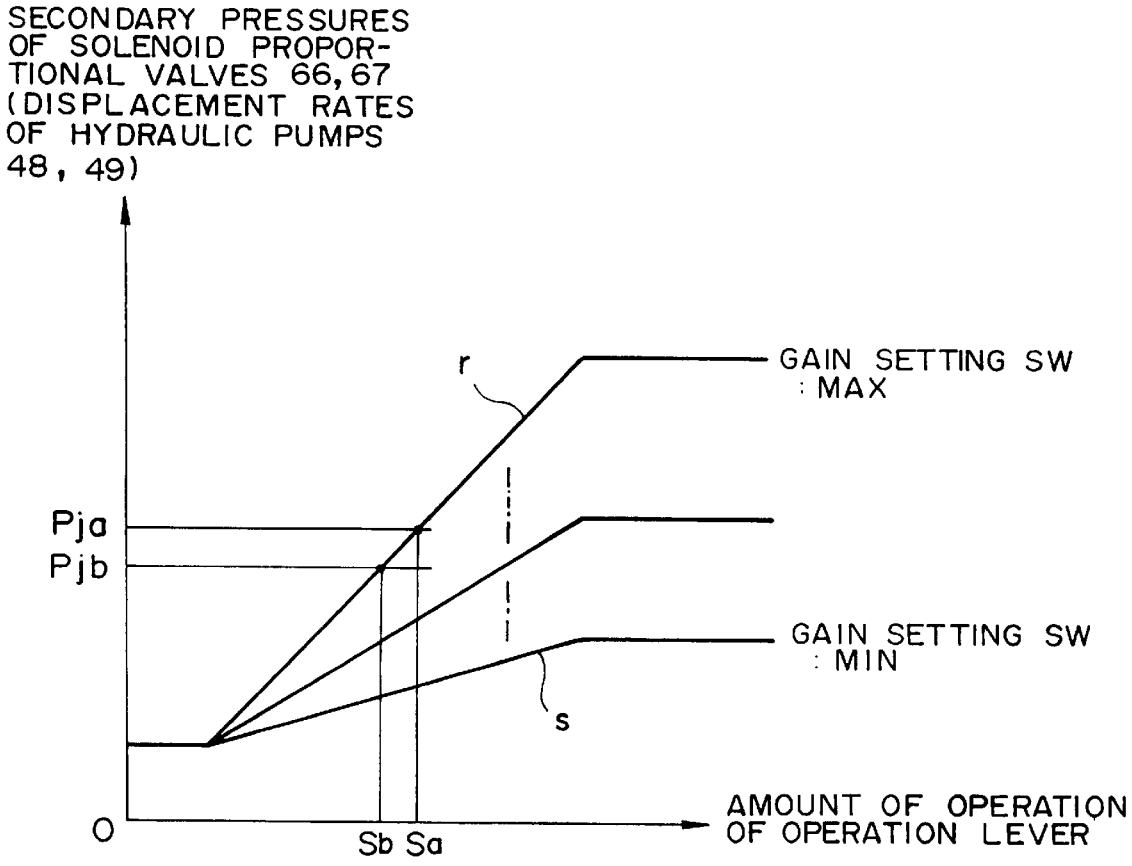
FIG. 10 is another diagram illustrative of the hydraulic control apparatus shown in FIG. 8.

The pump proportional valve control section 88 controls the supply of electrical currents to the solenoid proportional valves 66, 67 in order to control the rates of displacements of the working fluid from the hydraulic pumps 48, 49. Basically, the pump proportional valve control section 88 performs such a control as to enable the solenoid proportional valves 66, 67 to generate secondary pressures which are to be supplied as pilot pressures to the regulators 63, 64, such that these secondary pressures correspond to the amount of operation of the boom operation lever 50 and the amount of operation of the arm operation lever 52. In other words, the pump proportional valve control section 88 performs such a control that the rates of displacements of the working fluids from the hydraulic pumps 48 and 49 correspond to the amounts of operations of the boom operation lever 50 and the arm operation lever 52, respectively. As in the case of the solenoid proportional valve 77, the gain characteristics of the solenoid proportional valves 66, 67, i.e., the rates of changes of the secondary pressures of these valves 66, 67 and, hence, of the displacement rates of the hydraulic pumps 48, 49 with respect to the amounts of operations of the respective levers 50, 52, are changeable over a plurality of stages by means of the gain setting switch 86. Referring to FIG. 10, solid lines "r" and "s" represent the gain characteristics which are obtained when the gain setting switch 86 selects MAX and MIN positions, respectively. The gain characteristic is selectable between the gradients of the lines "r" and "s" as the gain setting switch 39 selects one of the positions or stages between the "MAX" and the "MIN". The pump proportional valve control section 88 controls the secondary pressures of the solenoid proportional valves 66, 67 in accordance with the gain characteristics set by the gain setting switch 86, such that the secondary pressures of the solenoid proportional valves 66, 67 and, hence, the rates of displacements from the hydraulic pumps 48 and 49, correspond to the amounts of operations of the operation levers 50 and 52.

In this embodiment, when the boom operation lever 50 and the arm operation lever 52 are simultaneously in operation for raising the boom 2 and for pulling the arm 3, respectively, i.e., when the horizontal pulling operation is being performed, the control effected by the pump proportional valve control section 82 on the solenoid proportional valve 67 associated with the hydraulic pump 49 is such that the electrical current supplied to this solenoid proportional valve 67 is controlled in accordance with the smaller one of the amount of operation of the boom operation lever 50 and the amount of operation of the arm operation lever 50 which are indicated by the pilot pressures Pa and Pb sensed by the pressure sensors 76, 77.

The described components of the hydraulic control apparatus provide the following structural features of the invention. The return proportional valve control section 87 in cooperation with the solenoid proportional valve 77 constitute a variable orifice control means 89, while the pump proportional valve control section 82 in cooperation with the solenoid proportional valves 66, 67 constitutes hydraulic pump control means 90.

A description will now be given of the operation, in particular the horizontal pulling operation, performed by the third embodiment of the hydraulic excavator in accordance.

For the purpose of conducting horizontal pulling work, the operator first operates the boom and arm operation levers 10, 12 such that the bucket 4 contacts the ground G and then operates the boom operation lever 50 and the arm operation lever 52 in the direction for raising the boom 2 and in the direction for pulling the arm 3. Basically, these levers 50, 52 are operated by almost the same amounts.

As a result, the pilot ports 57*a*, 62*a* of the boom spool valve 57 and the arm spool valve 62 receive pilot pressures corresponding to the amounts of operations of the operation levers 50, 52 (proportional to the lever operation amounts), so that these spool valves 57 and 62 are switched to positions B and E, respectively, as shown in FIG. 8, whereby the bottom-side chambers 5*a*, 5*a* of the boom actuating cylinders 5, 5 and the bottom-side chamber 6*a* of the arm actuating cylinder 6 are supplied with the working fluids at rates which correspond to the amounts of operations of the boom operation lever 50 and the arm operation lever 52.

Figure 11:
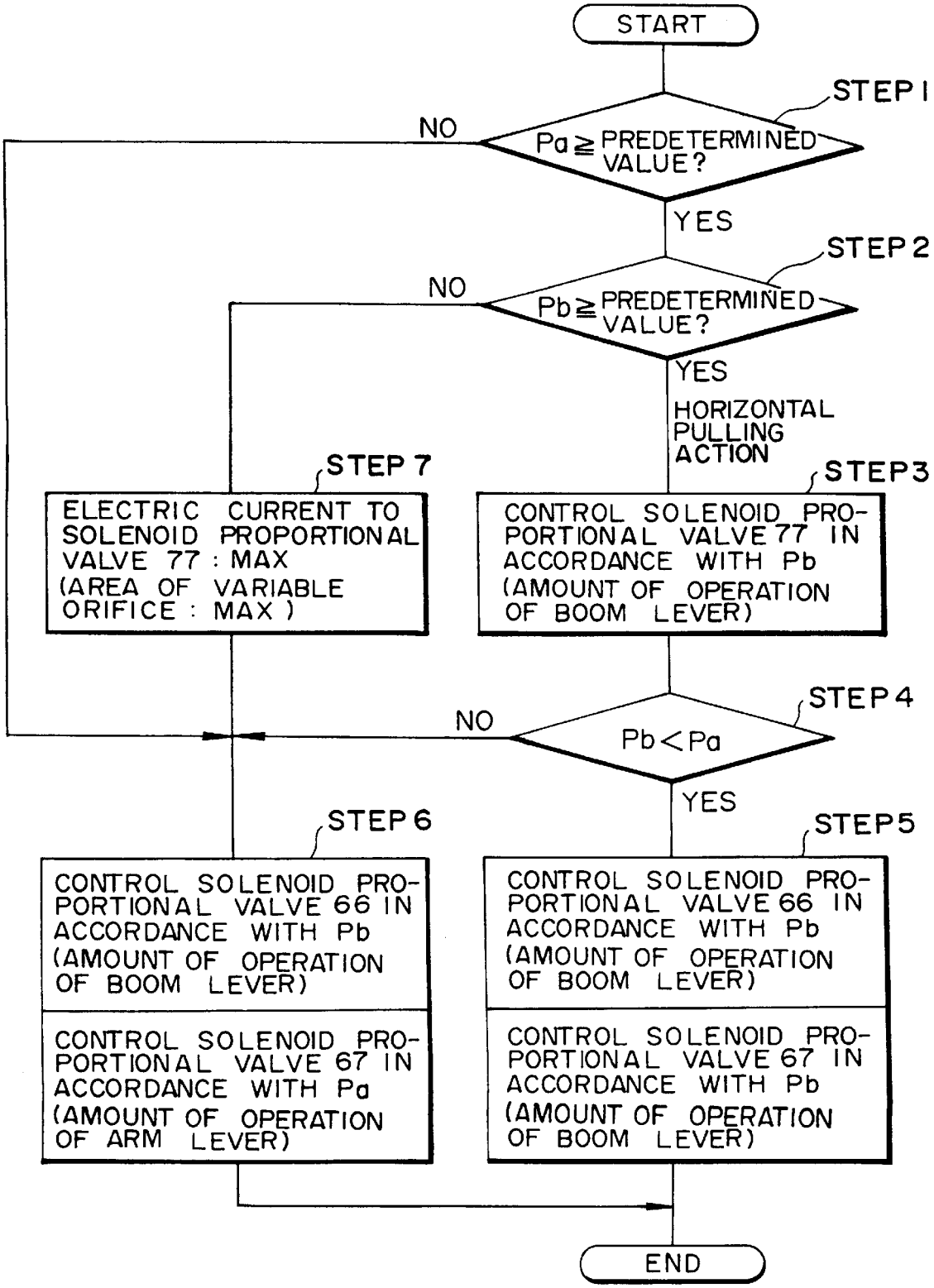
FIG. 11 is a flow chart illustrative of the hydraulic control apparatus shown in FIG. 8.

Simultaneously with the described operation, the controller 85 cyclically conducts a processing of the flowchart shown in FIG. 11, at a regular time interval. STEPs 1 and 2 determine whether or not the pilot pressures Pb, Pa sensed by the pressure sensors 83, 84 are not less than a predetermined pressure, in order to confirm that the horizontal pulling work is being executed. If the horizontal pulling work is being conducted, the boom operation lever 50 has been operated in the direction for raising the boom 2, while the arm operation lever 52 has been operated in the direction for pulling the arm 3. Therefore, the remote control valve devices 51, 53 produce, in the pilot conduits 79, 81, pilot pressures Pb, Pa of levels not lower than the predetermined pressure. Consequently, an answer YES is given to the question posed in STEPs 1 and 2, so that the process proceeds to STEP 3 in which the return proportional valve control section 87 controls the supply of electrical current to the solenoid proportional valve 77 corresponding to the return spool valve 71 in such a manner that the solenoid proportional valve 77 produces a secondary pressure corresponding to the pilot pressure Pb in the remote control valve device 51, in accordance with the gain characteristic (see FIG. 9) corresponding to the position of the gain setting switch 86.

As a result of the control of the solenoid proportional valve 77, the pilot port 71*a* of the return spool valve 71 receives a pilot pressure which corresponds to the pilot pressure Pb and, hence, to the amount of operation of the boom operation lever 50, whereby the passage area in the variable orifice 72 of the return spool valve 71 is controlled in accordance with the gain characteristic of FIG. 9, such that the passage area corresponds to the amount of operation of the boom operation lever 50.

In STEP 4, the pump proportional valve control section 88 of the controller 85 compares the pilot pressures Pa and Pb sensed by the pressure sensors 83, 84 with each other. When the condition Pb<Pa is met, i.e., when the amount of operation of the arm operation lever 52 is greater than the amount of operation of the boom operation lever 50, the process proceeds to STEP 5. In this step, the pump proportional valve control section 88 controls, in accordance with the gain characteristic (see FIG. 10) corresponding to the position of the gain setting switch 86, the supply of electrical current to the solenoid proportional valve 66 associated with the hydraulic pump 48 for supplying the working fluid to the boom actuating cylinders 5, 5, such that the solenoid proportional valve 66 produces a secondary pressure corresponding to the amount (pilot pressure Pb) of operation of the boom operation lever 50. At the same time, the pump proportional valve control section 88 controls, in accordance with the gain characteristic (see FIG. 10), the supply of electrical current to the solenoid proportional valve 67 associated with the hydraulic pump 49 for supplying the working fluid to the arm actuating cylinder 6 such that the solenoid proportional valve 67 produces a secondary pressure corresponding to the amount (pilot pressure Pb) of operation of the boom operation lever 50.

The control of the solenoid proportional valve 67 in STEP 5 will be described in detail with reference to FIG. 10. It is assumed here that the arm operation lever 52 and the boom operation lever 50 have been operated by amounts Sa and Sb (Sa>Sb), respectively, while the gain setting switch 86 has been set to the MAX position. In such a case, if the control of STEP 5 is not performed, the secondary pressure which is to be produced by the solenoid proportional valve 67 is the pressure "Pja" shown in FIG. 10 which corresponds to the amount Sa of operation of the arm operation lever 52. In the illustrated embodiment, however, the secondary pressure produced by the solenoid proportional valve 67 is controlled to "Pjb" (Pjb<Pja) which corresponds to the operation amount Sb which is smaller than the actual amount Sa of operation of the arm operation lever 52, as a result of control performed in STEP 5. Thus, in STEP 5, the controller 85 controls the electrical current to be supplied to the solenoid proportional valve 67 as if the arm operation lever 52 has been operated by an amount which is the same as the amount of operation of the boom operation lever 50 which is smaller than the actual amount of operation of the lever 52, so that the solenoid proportional valve 67 produces a secondary pressure which corresponds to the amount of operation of the boom operation lever 50 rather than to the actual amount of operation of the arm operation lever 52. The secondary pressure thus formed is delivered as the pilot pressure to the regulator 64.

In the event that a condition Pb≧Pa is found in STEP 4, i.e., when the amount of operation of the arm operation lever 52 is equal to or greater than the amount of operation of the boom operation lever 50, the process proceeds to STEP 6 in which the pump proportional valve control section 88 controls the electrical currents to be supplied to the solenoid proportional valves 66, 67 in accordance with the gain characteristics shown in FIG. 10, in such a manner that the solenoid proportional valves 66 and 67 produce secondary pressures which correspond to the amount of operation of the boom operation lever 50 (pilot pressure Pb) and the amount of operation of the arm operation lever 52 (pilot pressure Pa), respectively.

As a result of the control of the solenoid proportional valves 66, 67 executed in STEPs 5 and 6, the pilot port of the regulator 63 associated with the hydraulic pump 48 receives, from the solenoid proportional valve 66, the pilot pressure of the level which corresponds to the amount of operation of the boom operation lever 50, so that the regulator 63 controls the displacement of the fluid from the hydraulic pump 48 to a rate which corresponds to the amount of operation of the boom operation lever 50. At the same time, the pilot port of the regulator 64 associated with the hydraulic pump 49 receives, from the solenoid proportional valve 67, a pilot pressure which corresponds to the smaller one of the amount of operation of the boom operation lever 50 and the amount of operation of the arm operation lever 52, so that the regulator 64 controls the displacement from the hydraulic pump 49 to a rate which corresponds to the smaller one of the amount of operation of the boom operation lever 50 and the amount of operation of the arm operation lever 52.

When no operation of the arm operation lever 52 in the direction for pulling the arm 3 is being conducted, an answer NO is given to the question posed in STEP 1, so that the controller 85 conducts the control of STEP 6 described before, so that the displacement rates of the hydraulic pumps 48 and 49 are controlled to the rates corresponding to the amounts of operations of the boom operation lever 50 and the arm operation lever 52, respectively.

As will be understood from the foregoing description, when the amount of operation of the arm operation lever 52 has become large as compared with the amount of operation of the boom operation lever 50, the arm spool valve 62 operates in such a manner as to increase the arm pulling operation speed of the arm actuating cylinder 6 over the boom raising operation speed of the boom actuating cylinders 5, 5. In the meantime, however, the passage area in the variable orifice 72, through which the working fluid discharged from the rod-side chamber 6*b* of the arm actuating cylinder 6 returns to the bottom-side chamber 6*a* along the return circuit 70, is controlled to a small area corresponding to the amount of operation of the boom operation lever 50 which is smaller than the actual amount of operation of the arm operation lever 52, thus restricting the return circuit 70 to resist to the flow of the fluid returning from the rode-side chamber 6*b*. Consequently, the rising tendency of the operation speed of the arm actuating cylinder 6 in extending direction, i.e., in the direction for pulling the arm 3 towards the chassis 1, is suppressed, so as to avoid inconvenience such as cutting of the ground G by the bucket 4 on the free end of the arm 3.

In the meantime, the displacement of the hydraulic pump 49 for delivering the pressurized working fluid to the arm actuating cylinder 6 is controlled to a rate corresponding to the amount of operation of the boom operation lever 50 which is smaller than the actual amount of operation of the arm operation lever 52, so that the arm actuating cylinder 6, which is being retarded by the restriction of the return circuit 70, is supplied with the working fluid from the hydraulic pump 49 at the rate which has been reduced by the above-described control and which matches the retarded operation speed of the cylinder 6, whereby the behavior of the arm actuating cylinder 6 is stabilized.

Consequently, any slight excess of the amount of operation of the arm operation lever 52 over the amount of operation of the boom operation lever 50 does not cause the bucket 4 to cut into the ground G. It is therefore possible to smoothly conduct the ground levelling horizontal pulling work without requiring high degree of skill and experience.

In the described embodiment, the gain characteristics of the solenoid proportional valves 66, 67 and 77 are changeable over a plurality of stages by means of the gain setting switch 86. More specifically, the amount of change of the passage area in the variable orifice 72 and the amounts of changes of the displacement rates from the hydraulic pumps 48, 49 for given amounts of changes in the operation of the operation levers 50, 52 are variable over a plurality of stages by means of the gain setting switch 86. Therefore, the operator can conduct the horizontal pulling work with the gain characteristic selected in accordance with his favor or the conditions of the work. For instance, when the gain setting switch 86 is set to "MAX" position, the operation speeds of the boom actuating cylinders 5, 5 and the arm actuating cylinder 6 are changeable over wide ranges in response to the operations of the operation levers 50 and 52. Conversely, when the gain setting switch 39 is set to the "MIN" position, only small changes in the operation speeds of the boom actuating cylinders 5, 5 and the arm actuating cylinder 6 are caused in response to given changes in the amounts of operations of the boom operation lever 50 and the arm operation lever 52, thus enabling a fine control. It is therefore possible to accurately obtain the desired operation speeds of the respective cylinders.

Although the hydraulic excavator of the third embodiment employs variable displacement hydraulic pumps as the pumps 48 and 49, it will be clear that the invention can equally be carried out by using constant displacement hydraulic pumps as the hydraulic pumps which deliver the pressurized working fluid to the boom actuating cylinders 5,5 and the arm actuating cylinder 6. When constant displacement hydraulic pumps are used, the described control in the horizontal pulling work is implemented by controlling the pilot pressure supplied to the return spool valve 71 in the same manner as the described third embodiment.

Furthermore, although in the third embodiment the return spool valve 71 is of the type which increases the passage area in the variable orifice in accordance with increase of the pilot pressure, this is not exclusive and the third embodiment may be modified such that the return spool valve decreases the passage area of the variable orifice in accordance with a rise in the pilot pressure. In such a modification, the arrangement should be such that the pilot pressure applied to the return spool valve is reduced in accordance with an increase of the amount of operation of the boom operation lever 50 which is indicated by the pilot pressure Pb.

The third embodiment as described is equipped with the return circuit 70 which allows the working fluid discharged from the rod-side chamber 6*b* of the arm actuating cylinder 6 to return to the bottom-side chamber 6*a* of the same valve and which has a variable orifice 72. The provision of such a return circuit, however, is not essential. Namely, the third embodiment may be applied to a hydraulic excavator of the type in which the working fluid discharged from the rod-side chamber 6*b* of the arm cylinder 6 is collected in the working fluid tank 18. In such a case, a variable orifice is provided in the passage through which the working fluid discharged from the rod-side chamber 6*b* of the arm actuating cylinder 6 returns to the working fluid tank 18, and the area of the passage defined in the variable orifice is controlled in accordance with the method used in the third embodiment as described.

The third embodiment also may be modified to include an operation switch 91 which is shown by imaginary lines in FIG. 8. The operation switch 91 can selectively set the controller 45 to a mode which prohibits the execution of the control of the variable orifice 72, thus serving as prohibiting means. For instance, when the operator wishes that the control of the variable orifice 72 as described is executed, he turns the operation switch 91 ON so that the controller 45 is set to the mode in which the control is executed. When the operation switch 91 is turned OFF, the control of the variable orifice 72 is not conducted. For instance, the passage area in the variable orifice 72 is fixedly maintained at the maximum area. When the operator wishes to conduct a work which is different from the horizontal pulling work and which also requires the simultaneous boom raising and arm pulling operations, he can dismiss the horizontal pulling work control mode so as to conduct such a work in normal state, simply by turning the operation switch 91 OFF.

A fourth embodiment of the present invention will be described with reference to FIGS. 12 to 16. The basic structure of the hydraulic excavator of the fourth embodiment is substantially the same as that of the first embodiment described in connection with FIG. 1, so that detailed description of such basic structure is omitted.

Figure 12:
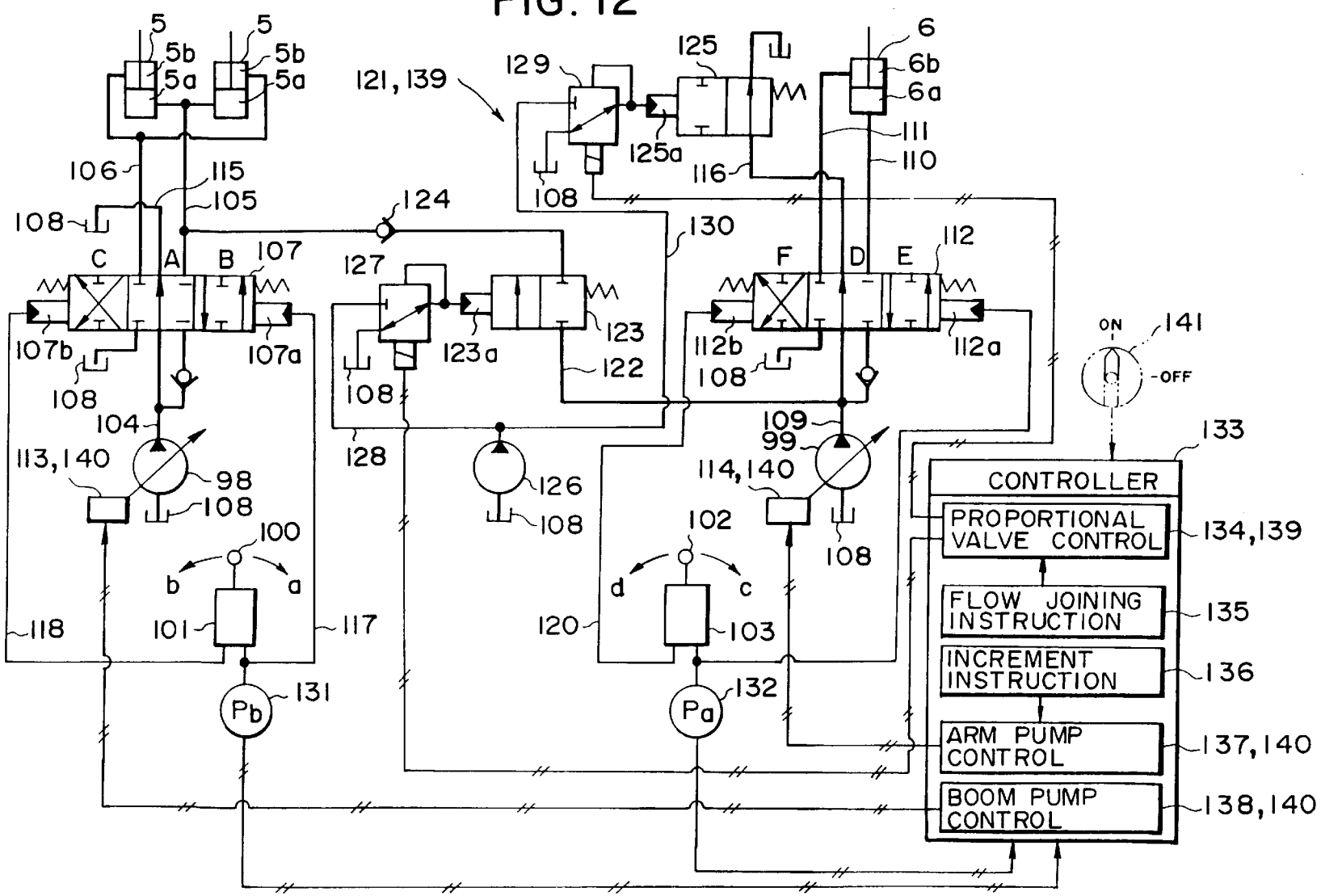
FIG. 12 is a block diagram showing the construction of a hydraulic control apparatus in accordance with a fourth embodiment, for use on the hydraulic excavator shown in FIG. 1.

The hydraulic excavator in accordance with the fourth embodiment of the present invention has a chassis 1 which carries a hydraulic control apparatus of the type shown in FIG. 12, for the purpose of controlling the operations of the boom actuating cylinders 5, 5 and the arm actuating cylinder 6.

Referring to FIG. 12, the hydraulic control apparatus has a pair of variable displacement hydraulic pumps 98, 99, a remote control valve device 101 having a boom operation lever 100 for operating the boom 2, and a remote control valve device 103 having an arm operation lever 102 for operating the arm 3.

A conduit 104 leading from the outlet port of the hydraulic pump 98 is connected, through a boom spool valve 107, to a conduit 105 which leads to the bottom-side chambers 5*a*, 5*a* of the boom actuating cylinders 5, 5 and also to a conduit 106 which leads from the rod-side chambers 5*a*, 5*a* of the same cylinders 5, 5. The arrangement is such that working fluid sucked from a working fluid tank 108 is supplied through the boom spool valve 107 to the bottom-side chambers 5*a*, 5*a* or the rod-side chambers 5*b*, 5*b*.

Similarly, a conduit 109 (working fluid supply passage), leading from the outlet port of a hydraulic pump 99 is connected, through an arm spool valve 112, to a conduit 110 leading to the bottom-side chamber 6*a* of the arm actuating cylinder 6 and also to a conduit 111 which leads to the rod-side chamber 6*b* of the cylinder 6. Working fluid sucked from the working fluid tank 108 is supplied to the bottom-side chamber 6*a* or to the rod-side chamber 6*b* of the arm actuating cylinder 6, through the arm spool valve 112.

The hydraulic pumps 98, 99 are variable displacement hydraulic pumps. Thus, displacement rates from these pumps 98, 99 are controllable through control of tilt angle of swash plates performed by regulators 113, 114. The regulators 113, 114 are adapted to regulate the tilt angles in the hydraulic pumps 98, 99 in accordance with displacement rate command signals given by a controller 133 which will be described later.

The boom spool valve 107 has a spool (not shown) which is movable to allow the spool valve 107 to be switched over a position A (neutral), a position B and a position C. The boom spool valve 107, when in the neutral position A, blocks the passage between the hydraulic pump 98 and the boom actuating cylinders 5, 5 so as to keep the boom actuating cylinders 5, 5 inoperative. The boom spool valve 107, when in the position B, permits the bottom-side cylinders 5*a*, 5*a* of the boom actuating cylinders 5, 5 to be connected to the hydraulic pump 98, so that the working fluid displaced from the hydraulic pump 98 is supplied into the bottom-side chambers 5*a*, 5*a*, whereby the boom actuating cylinders 5, 5 are operated to extend, with the result that the boom 2 is raised. The boom spool valve 107, when in the position C, permits the rod-side cylinders 5*b*, 5*b* of the boom actuating cylinders 5, 5 to be connected to the hydraulic pump 98, so that the working fluid displaced from the hydraulic pump 98 is supplied into the rod-side chambers 5*b*, 5*b*, whereby the boom actuating cylinders 5, 5 are operated to contract, with the result that the boom 2 is lowered. The boom spool valve 107 is provided with a pair of pilot ports 107*a*, 107*b*, and is held in the neutral position A when no pilot pressure acts in these pilot ports 107*a*, 107*b*. The spool of the boom spool valve 107 is switched to the position B or the position C, when the pilot pressure is supplied to the pilot port 107*a* or the pilot port 107*b*. As a result of this switching of the spool in the boom spool valve 107, the pressurized working fluid from the hydraulic pump 98 is supplied either to the bottom-side chambers 5*a*, 5*a* or to the rod-side chambers 5*b*, 5*b* of the boom actuating cylinders 5, 5, at a rate which corresponds to the level of the pilot pressure supplied to the pilot port 107*a* or 107*b*.

Similarly, the arm spool valve 112 is switchable over three states including a position D (neutral position), a position E and a position F. The arm spool valve 112, when in the neutral position D, blocks the working fluid passage between the hydraulic cylinder 99 and the arm actuating cylinder 6, thereby maintaining the arm actuating cylinder 6 inoperative. The arm spool valve 112, when in position E, connects outlet of the hydraulic pump 99 to the bottom-side chamber 6*a* of the arm actuating cylinder 6, thereby causing the arm actuating cylinder 6 to extend, with the result that the arm 3 is pulled. The arm spool valve 112, when in position F, connects outlet of the hydraulic pump 99 to the rod-side chamber 6*b* of the arm actuating cylinder 6, thereby contracting the arm actuating cylinder 6, with the result that the arm 3 is pushed forward. The arm spool valve 112 has a pair of pilot ports 112*a*, 112*b*, and is held in the neutral position D when no pilot pressure acts in these pilot ports 112*a*, 112*b*. When pilot pressure is supplied to the pilot port 112*a* or 112*b*, the arm spool valve 112 is switched from the position D to the position E or F. When the arm spool valve 112 is in the position E or F, pressurized working fluid is supplied from the hydraulic pump 99 to the bottom-side chamber 6*a* or the rod-side chamber of the arm actuating cylinder 6, at a rate corresponding to the level of the pilot pressure supplied to the pilot port 112*a* or 112*b*.

The remote control valve device 101 produces, in accordance with the direction and amount of operation of the boom operation lever 100, the pilot pressure for operating the boom spool valve 107 in the manner described. The remote control valve device 101 is connected to the pilot port 107*a* of the boom spool valve 107, through a pilot conduit 117 and also to the pilot port 107*b* of the same spool valve 107 through a pilot conduit 118. For raising the boom 2, the operator operates the boom operation lever 100 in the direction of the arrow "a". For lowering the boom, the lever 100 is moved in the direction of the arrow "b". An operation of the boom operation lever 100 in the direction for raising the boom 2 (direction "a") causes the remote control valve device 101 to produce a pilot pressure corresponding to (proportional to) the amount of operation of the lever 100 in the pilot conduit 117. Conversely, when the boom operation lever 100 is operated in the direction for lowering the boom 2 (direction "b"), the remote control valve device 101 operates so as to produce, in the pilot conduit 118, a pilot pressure corresponding to (proportional to) the amount of operation of the lever 100.

Similarly, the remote control valve device 103 produces, in accordance with the direction and amount of operation of the arm operation lever 102, the pilot pressure for operating the arm spool valve 112 in the manner described. The remote control valve device 103 is connected to the pilot port 112*a* of the arm spool valve 112 through a pilot conduit 119 and also to the pilot port 112*b* of the same spool valve 112 through a pilot conduit 120. For pulling the arm 3 towards the chassis 1, the operator operates the arm operation lever 102 in the direction of the arrow "c". For pushing the arm 3 forward away from the chassis 1, the lever 102 is moved in the direction of the arrow "d". An operation of the arm operation lever 102 in the direction for pulling the arm 3 (direction "c") causes the remote control valve device 103 to produce a pilot pressure corresponding to (proportional to) the amount of operation of the lever 102 in the pilot conduit 119. conversely, when the arm operation lever 102 is operated in the direction for pushing the arm 3 forward (direction "d"), the remote control valve device 103 operates so as to produce, in the pilot conduit 120, a pilot pressure proportional to the amount of operation of the lever 102.

The hydraulic control apparatus shown in FIG. 12 further has a boom fluid joining mechanism 121 which, when the boom actuating cylinders 5, 5 are operated in extending direction (direction for raising the boom 2), operates so that the hydraulic fluid displaced from the hydraulic pump 99 joins the hydraulic fluid displaced from the hydraulic pump 98 so as to be supplied to the bottom-side chambers 5*a*, 5*a* of the boom actuating cylinders 5,5, together with the working fluid displaced from the hydraulic pump 98, as will be seen from the following description.

The boom fluid joining mechanism 121 includes: a fluid joining conduit 122 which shunts from the aforementioned conduit 109 connected to the outlet port of the hydraulic pump 99 and merging in the aforesaid conduit 105 which leads to the bottom-side chambers 5*a*, 5*a* of the boom actuating cylinders 5, 5; a boom fluid joining valve 123 disposed in the joining conduit 122 and a check valve 124 which also is provided in the joining conduit 122 downstream of the boom fluid joining valve 123; and a cut valve 125 which is disposed in the aforesaid conduit 116 through which the hydraulic fluid discharged from the hydraulic pump 99 is collected in the working fluid tank 108 when the arm spool valve 112 is in the neutral position (D position).

The boom fluid joining valve 123 is a spool valve for selectively opening and closing the fluid joining conduit 122, and is normally urged to a position for closing the conduit 122. When a pilot pressure is supplied to the pilot port 123*a* of the boom fluid joining valve 123, a spool of the boom fluid joining valve 123 is displaced so as to open the fluid joining passage 122. The pilot port 123*a* of the boom fluid joining valve 123 is connected to the discharge port of a pilot pump 126 which is separate from the aforementioned hydraulic pumps 98, 99, through a pilot conduit 128 which has a solenoid proportional valve 127. Thus, the pilot pressure is delivered from the pilot pump 126 to the pilot port 123*a* of the boom fluid joining valve 123 through the solenoid proportional valve 127. The solenoid proportional valve 127 receives pressurized working fluid from the pilot pump 126 and changes the pressure into a secondary pressure of a level proportional to the level of electrical current supplied thereto, and the secondary pressure thus generated is supplied as the pilot pressure to a pilot port 125*a* of the cut valve 125. The solenoid proportional valve 125, when not energized, opens the pilot port 125*a* to the working fluid tank 108.

The check valve 124 serves to prevent the pressurized fluid from flowing back to the hydraulic pump 99 from the boom actuating cylinders 5, 5 during the joining of the working fluid.

The hydraulic control apparatus of FIG. 12 further has: a boom fluid pressure sensor 131 which senses a pilot pressure Pb generated by the remote control valve device 101 in accordance with the amount of operation of the boom operation lever 100 in the direction for raising the boom 2; an arm fluid pressure sensor 132 which senses a pilot pressure Pa generated by the remote control valve device 103 in accordance with the amount of operation of the arm operation lever 102 in the direction for pulling the arm 3; and a controller 133 which controls the solenoid proportional valves 127, 129 and regulators 131, 132.

The pressure sensors 131, 132 are connected to pilot conduits 117, 119 and, upon sensing the pilot pressures Pb and Pa in these conduits 117, 119, supply the controller 133 with signals corresponding to the levels of the pilot pressures Pb, Pa which are indicative of the amounts of operations of the operation levers 100, 102.

The controller 133 comprises, for example, a microcomputer, and has the following functional sections: a proportional valve control section 134; a fluid joining instruction section 135; an increment instruction section 136; an arm pump control section 137; and a boom pump instruction section 138.

The proportional valve control section 134 controls the electrical currents to be supplied to the solenoid proportional valves 127, 129 in accordance with characteristics which are given by the fluid joining instruction section 135 as will be described later, in such a manner that the secondary pressures produced by these valves 127, 129 correspond to the amount of operation of the boom operation lever 100 in the direction for raising the boom 2 indicated by the pilot pressure Pb sensed by the pressure sensor 131. The proportional valve control section 134, in cooperation with the aforementioned boom fluid joining mechanism 121, a boom fluid joining means 139.

The fluid joining instruction section 135 gives to the proportional valve control section 134 an instruction concerning the characteristics in accordance with which the secondary pressures are to be produced by the solenoid proportional valves 127, 129 in accordance with the amount of operation of the boom operation lever 100, i.e., the characteristics in accordance with which the pilot pressures to be supplied to the pilot ports 123*a* and 125*a* of the boom fluid joining valve 123 and the cut valve 125 are to be produced. Basically, the fluid joining instruction section 135 gives to the proportional valve control section 134 an instruction such that the solenoid proportional valves 127, 129 produce secondary pressures in accordance with characteristics shown by straight solid lines p1 and p2 in FIGS. 13 and 14, wherein, starting from the initial pressure of Pb=Pb1 corresponding to a predetermined amount S1 of operation of the boom operation lever 100, the secondary pressures of the solenoid proportional valves 127, 129, i.e., the pilot pressures, increase in proportion to an increase of the amount of operation of the boom operation lever 100. This operation characteristic will be referred to as "proportional valve non-delay characteristic".

The fluid joining instruction section 135 is capable of detecting that the boom operation lever 100 and the arm operation lever 102 are being operated simultaneously in the direction for raising the boom 2 and in the direction for pulling the arm 3, respectively, i.e., that the hydraulic excavator is conducting horizontal pulling work, upon detecting that the levels of the pilot pressures Pb, Pa sensed by the pressure sensors 131, 132 are not lower than a predetermined level. The fluid joining instruction section 135, when it has detected that the hydraulic excavator is conducting horizontal pulling work, gives to the proportional valve control section 134 an instruction such that the solenoid proportional valves 127, 129 produce secondary pressures in accordance with characteristics as shown by straight broken lines q1 and q2, wherein, starting from an initial pressure of Pb=Pb2 corresponding to a predetermined amount S2 of operation of the boom operation lever 100 which is greater than the aforesaid operation amount S1, the secondary pressures, i.e., pilot pressures, increase in proportion to the increase of the operation amount of the boom operation lever 100, at the same gradient as that of the proportional valve non-delay characteristics shown by the solid lines p1 and p2. This secondary pressure producing characteristic conducted during horizontal pulling work is delayed behind that in the operation other than the horizontal pulling work and, hence, is referred to as "proportional valve delay characteristic".

The fluid joining instruction section 135 constitutes a fluid joining delaying means as a feature of the present invention.

Figure 15:
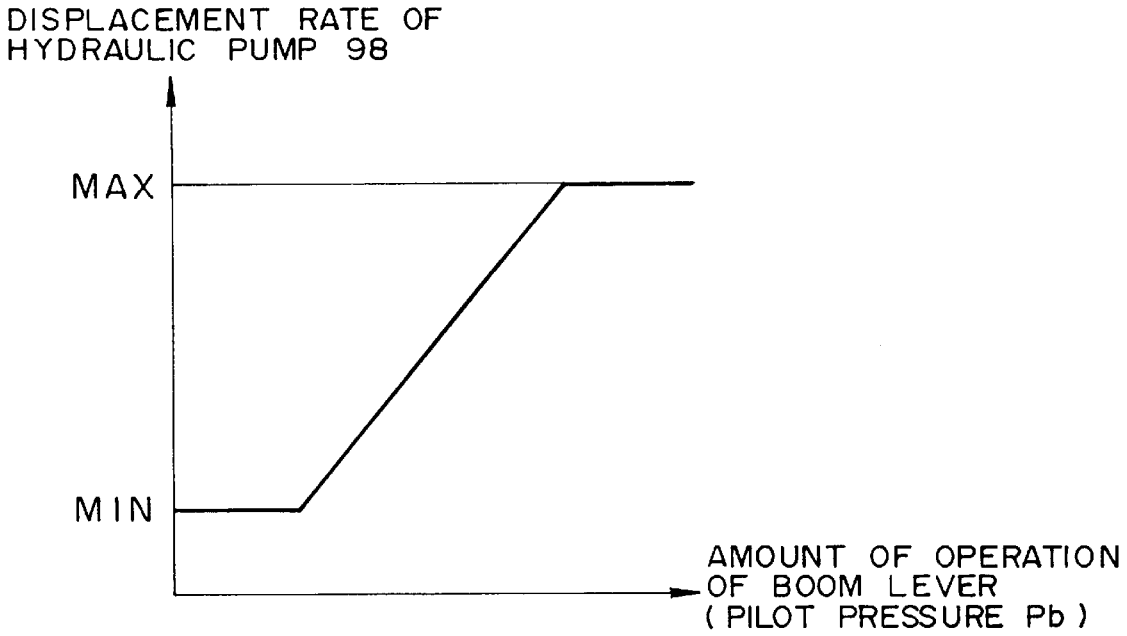
FIG. 15 is still another diagram illustrative of the operation of the hydraulic control apparatus shown in FIG. 12.

The boom pump control section 138 controls the rate of displacement of the working fluid from the hydraulic pump 98 through an operation of the regulator 113, such that the hydraulic pump 98 displaces pressurized working fluid at a rate which corresponds to the amount (indicated by pilot pressure Pb) of operation of the boom operation lever 100 in the direction for raising the boom 2, in accordance with characteristic as shown in FIG. 15. The boom pump control section 138 also performs, through the operation of the regulator 113, such a control as to provide the displacement rate from the hydraulic pump 98 corresponding to the amount of operation of the boom operation lever 100, when the boom operation lever 100 is being operated in the direction for lowering the boom 2.

Figure 16:
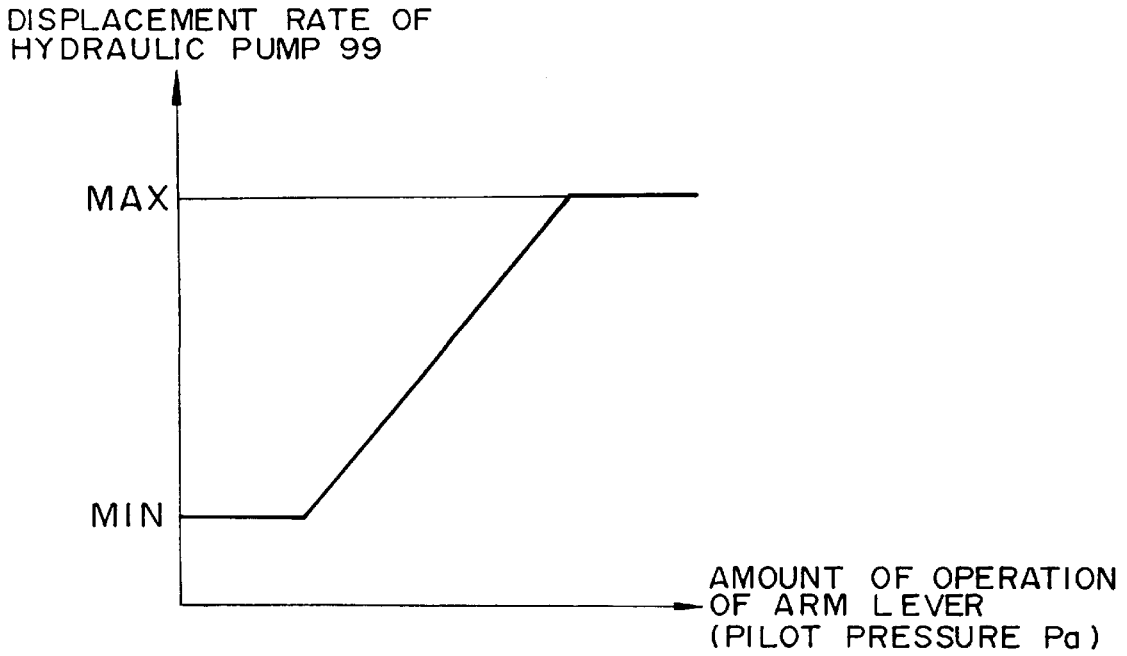
FIG. 16 is a further diagram illustrative of the operation of the hydraulic control apparatus shown in FIG. 12.

The arm pump control section 137 controls the rate of displacement of the pressurized working fluid from the hydraulic pump 99, through an operation of the regulator 114. Basically, similarly to the case of the control performed by the boom pump control section 138, the rate of displacement of the pressurized working fluid by the hydraulic pump 99 is controlled so as to correspond to the amount of operation of the arm operation lever 102, in accordance with a characteristic as shown in FIG. 16. However, when the boom fluid joining operation is conducted so that the working fluid from the hydraulic pump 99 joins the working fluid from the hydraulic pump 98 so as to be supplied to the boom actuating cylinders 5, 5, the arm pump control section 138 conducts such a control as to increase, through the operation of the regulator 114, the displacement rate of the hydraulic pump 99 to the maximum displacement as required, in accordance with characteristic given by the increment instruction section 136 in a manner which will be described later.

The increment instruction section 136 gives to the arm pump control section 137 the characteristic of incremental control of the displacement rate of the hydraulic pump 99 corresponding to the amount of operation of the boom operation lever 100 indicated by the pilot pressure Pb, in order to trigger the above-described fluid joining operation during operation of the boom operation lever 100 in the direction for raising the boom 2. Basically, the increment instruction section 136 gives to the arm pump control section 137 an instruction for providing increment of the displacement rate of the hydraulic pump 99 corresponding to the amount of operation of the boom operation lever 100 (indicated by pilot pressure Sb), in accordance with a characteristic as shown by a solid straight line "r" in FIG. 17, wherein, starting from the initial condition of the pilot pressure of Pb=Pb1 corresponding to the predetermined amount S1 (see FIGS. 13 and 14) of the boom operation lever 100, the displacement of the hydraulic pump 99 is increased in proportion to an increase of the operation amount of the boom operation lever 100. This characteristic will be referred to as "pump displacement increment non-delay characteristic".

Similarly to the case of the fluid joining instruction section 135, the increment instruction section 136 can detect that the boom raising operation of the boom operation lever 100 and the arm pulling operation of the arm operation lever 102 are being simultaneously performed to conduct the horizontal pulling work, based on the pilot pressures sensed by the pressure sensors 131, 132. The increment instruction section 136, when it has detected that the horizontal pulling work is being conducted, gives instruction to the arm pump control section 137 for obtaining increment of the displacement rate of the hydraulic pump 99 corresponding to the operation amount (pilot pressure Pb) of the boom operation lever 100, in accordance with a characteristic shown by a broken line "s" in FIG. 17, wherein, starting from an initial condition corresponding to the aforementioned predetermined operation amount S2 (S2>S1) of the boom operation lever 100, the displacement rate of the hydraulic pump 99 is increased in proportion to an increase of the operation amount of the boom operation lever 100, at the same gradient as that in the aforementioned pump increment non-delay characteristic. Thus, the characteristic of the pump displacement increment control as described will be referred to as "pump increment delay characteristic".

The increment instruction section 137 constitutes the increment delaying means which is one of the features of the present invention.

The boom pump control section 138 and the arm pump control section 137, together with the regulators 113 and 114, constitute the hydraulic pump control means which also is one of the features of the present invention.

A description will now be given as to the operation of the hydraulic excavator of this embodiment.

The description will be directed first to the basic operation performed when the boom operation lever 100 is operated in the direction for raising the boom 2, except for the case where the arm operation lever 102 is operated in the direction for pulling the arm 3 simultaneously with this operation of the boom operation lever 100.

An operation of the boom operation lever 100 in the direction of the arrow "a" for raising the boom 2 causes the remote control valve device 101 to produce, in the pilot conduit 117, a pilot pressure Pb proportional to the amount of operation of this lever 100. The pilot pressure Pb thus produced is delivered to the pilot port 107*a* of the boom spool valve 107. As a result, the spool (not shown) of the boom spool valve 107 is moved in response to the pilot pressure Pb so that the boom spool valve 107 is switched to the position or state B, thus providing a communication between the conduit 104 leading from the hydraulic pump 98 and the conduit 105 which lead to the bottom-side chambers 5*a*, 5*a* of the boom actuating cylinders 5, 5. In the meantime, the boom pump control section 138 of the controller 133 detects that amount of operation of the boom operation lever 100 based on the pilot pressure Pb sensed by the pressure sensor 131, and performs the control in accordance with the characteristic of FIG. 15 so as to obtain the displacement rate of the hydraulic pump 98 corresponding to the amount of operation of the boom operation lever 100, by operating the regulator 113.

Consequently, the bottom-side chambers 5*a*, 5*a* of the boom actuating cylinders 5, 5 are supplied with pressurized working fluid from the hydraulic pump 98 at the rate corresponding to the amount of operation of the boom operation lever 100, so that the boom actuating cylinders 5, 5 extend at a speed corresponding to the amount of operation of the boom operation lever 100, thus commencing raising of the boom 2.

Figure 13:
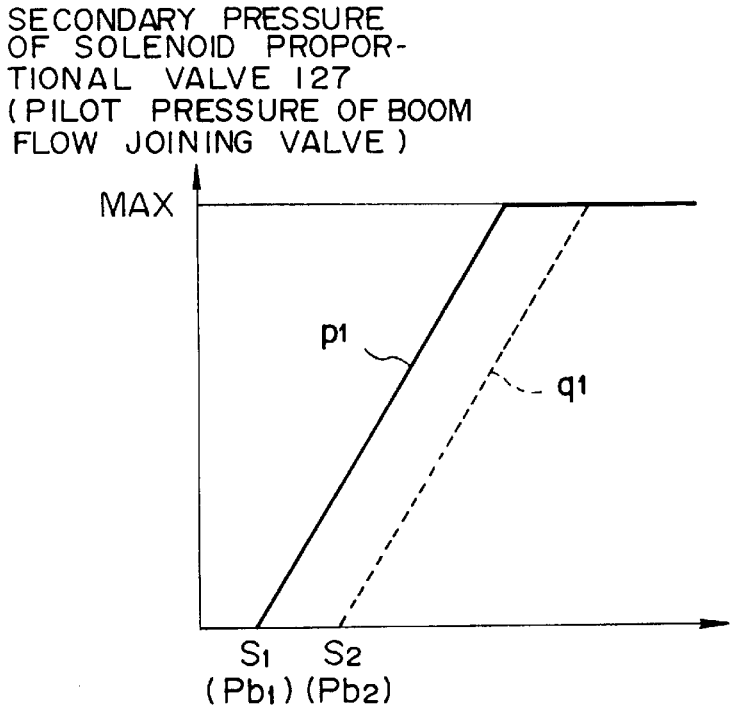
FIG. 13 is a diagram illustrative of the operation of the hydraulic control apparatus shown in FIG. 12.
Figure 14:
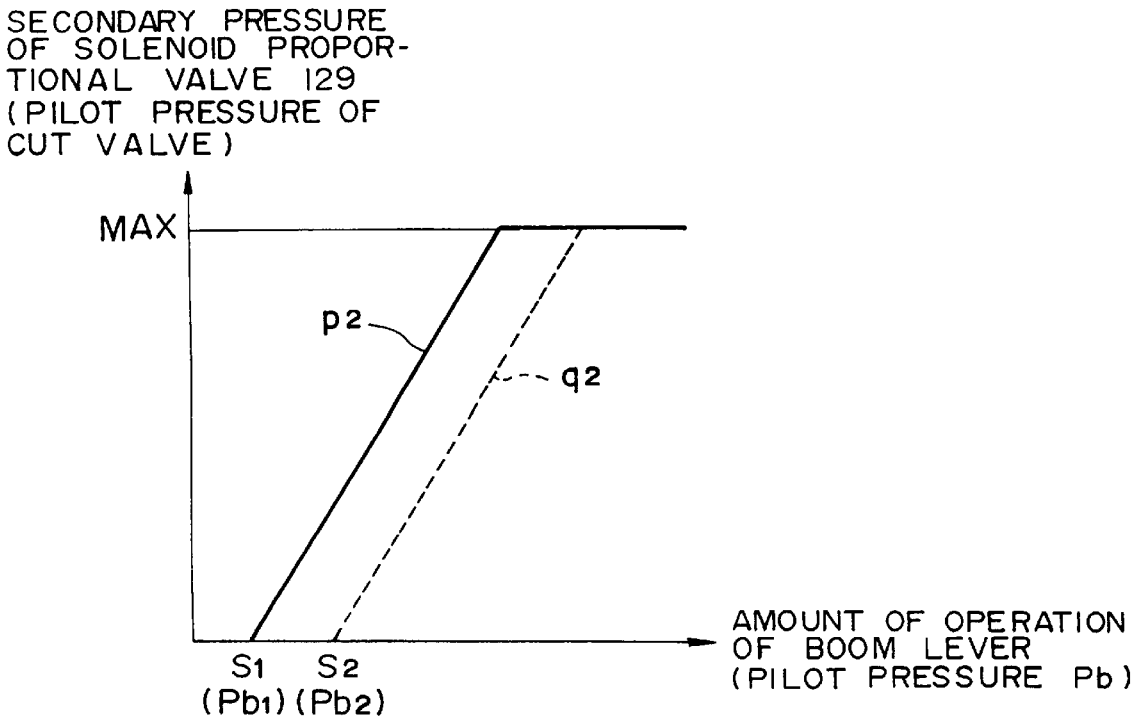
FIG. 14 is another diagram illustrative of the operation of the hydraulic control apparatus shown in FIG. 12.

When the operation amount reaches the aforesaid predetermined amount S1 (see FIGS. 13 and 14) as a result of further operation of the boom operation lever 100 in the boom raising direction, the fluid joining instruction section 135 of the controller 133 gives to the proportional valve control section 134 an instruction for supplying the pilot ports 123*a* and 125*a* of the boom fluid joining valve 123 and the cut valve 125 with the pilot pressure proportional to the amount of operation of the boom operation lever 100, in accordance with the proportional valve non-delay characteristic as shown by the solid lines p1 and p2 in FIGS. 13 and 14. Upon receipt of the instruction the proportional valve control section controls the supply of electrical currents to the solenoid proportional valves 127, 129. As a result, a spool (not shown) of the boom fluid joining valve 123 moves in the opening direction in accordance with the pilot pressure applied thereto, i.e., in accordance with the amount of operation of the boom operation lever 100, whereby the fluid joining conduit 122 is opened to provide an opening area which corresponds to the amount of operation of the boom operation lever 100. Conversely, in the cut valve 125, the aforementioned conduit 116 is restricted in accordance with the amount of operation of the boom operation lever 100.

Figure 17:
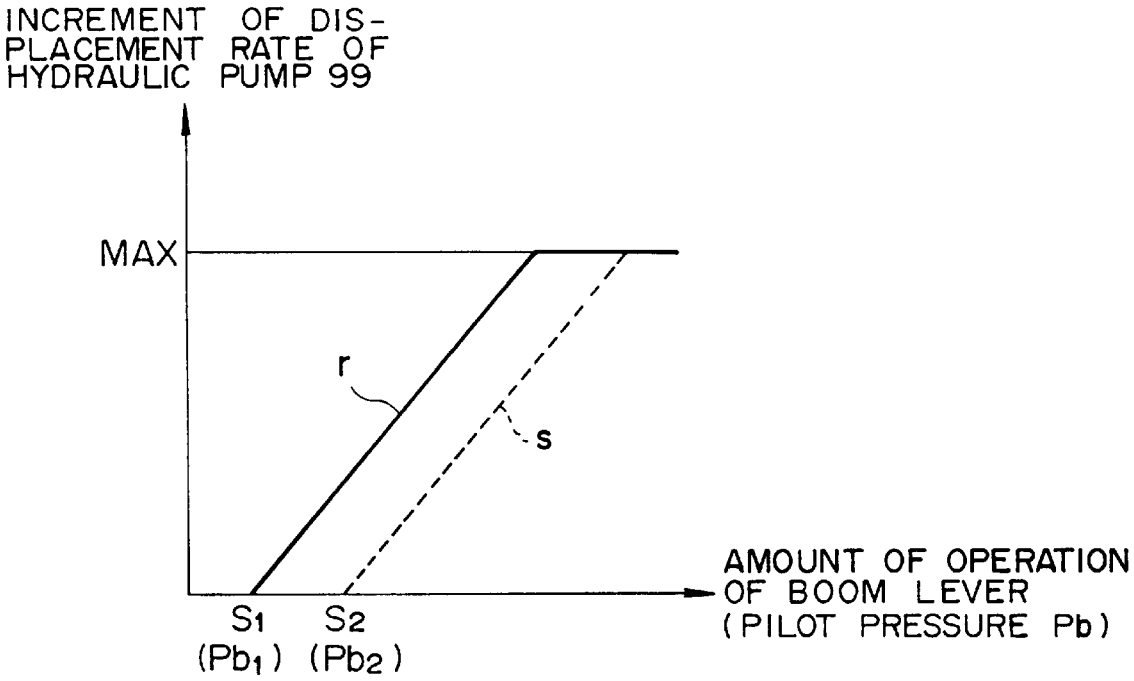
FIG. 17 is a further diagram illustrative of the operation of the hydraulic control apparatus shown in FIG. 12.

In the meantime, the increment instruction section 136 of the controller 133 gives to the arm pump control section 137 an instruction for increasing the displacement rate of the hydraulic pump 99 in proportion to the amount of operation of the boom operation lever 100, in accordance with the pump increment non-delay characteristic shown by the solid line "r" in FIG. 17. In response to the instruction, the arm pump control section 137 performs the control for increasing the displacement rate of the hydraulic pump 99, through the operation of the regulator 114.

Consequently, the working fluid displaced by the hydraulic pump 99 joins, through the fluid joining conduit 122, the working fluid which is being supplied from the hydraulic pump 98. Thus, the working fluid from the hydraulic pump 99 also is supplied to the bottom-side chambers 5*a*, 5*a* of the boom actuating cylinders 5, 5, together with the working fluid from the hydraulic pump 98. Thus, the boom actuating cylinders 5, 5 are supplied with the working fluid both from the hydraulic pumps 98 and 99. Consequently, the rate of supply of the working fluid to the boom actuating cylinders 5, 5 is increased to correspondingly increase the speeds of operation of these cylinders 5, 5 and hence the speed of raising of the boom 2. The timing at which the joining of the fluid is actually commenced to allow the fluid from the hydraulic pump 99 to be supplied to the boom actuating cylinders 5, 5 depends on the level of the load borne by the boom actuating cylinders. Generally, however, this timing lags behind the timing at which the above-mentioned predetermined operation amount S1 is reached by the boom operation lever 100.

A description will now be given of the operation performed during the horizontal pulling work.

For the purpose of conducting the horizontal pulling work, the operator first places the bucket 4 in contact with the ground G and then operates the boom operation lever 100 and the arm operation lever 102 simultaneously in the boom raising direction (direction of the arrow "a" in FIG. 12) and in the arm pulling direction (direction of the arrow "c" in FIG. 12), respectively, basically by almost the same operation amounts.

In response to this lever operation, the remote control valve devices 101 and 103 operate such that pilot pressures Pb and Pa corresponding to the amounts of operations of the levers 100 and 102 are supplied to the pilot ports 107*a* and 112*a* of the boom spool valve 107 and the arm spool valve 112. Consequently, the boom spool valve 107 and the arm spool valve 112 are respectively switched to the positions B and E shown in FIG. 12, so that the bottom-side chambers 5*a*, 5*a* of the boom actuating cylinders 5, 5 and the bottom-side chamber 6*a* of the arm actuating cylinder 6 are supplied with the pressurized hydraulic fluid at rates corresponding to the amount of operation of the boom operation lever 100 and the amount of operation of the arm operation lever 102, respectively.

Simultaneously with the operation described above, the boom pump control section 138 of the controller 133 performs, as described before, the control in accordance with the characteristic shown in FIG. 15 so as to obtain, through the operation of the regulator 113, the displacement rate from the hydraulic pump 98 corresponding to the amount of operation of the boom operation lever 100. Similarly, the arm pump control section 137 performs the control in accordance with the characteristic shown in FIG. 16 so as to obtain, through the operation of the regulator 114, the displacement rate from the hydraulic pump 99 corresponding to the amount of operation of the arm operation lever 102.

As a consequence, pressurized working fluid is supplied to the bottom-side chambers 5*a*, 5*a* of the boom actuating cylinders 5, 5 and to the bottom-side chamber 6*a* of the arm actuating cylinder 6 from the associated hydraulic pumps 98 and 99 at the rates corresponding to the amounts of operations of the operation levers 100 and 102, whereby the actuating cylinders 5, 5 and 6 are caused to extend at speeds corresponding to the lever operation amounts, thus commencing raising of the boom 2 and pulling of the arm 3 to start the horizontal pulling work.

When the horizontal pulling work is being conducted, the pilot pressures Pb and Pa sensed by the pressure sensors 131, 132 are above the predetermined levels, thus informing the controller 133 that the horizontal pulling work is being executed. When execution of the horizontal pulling work is acknowledged by the controller 133, the fluid joining instruction section 135 of the controller gives to the proportional valve control section 134 so as to cause the fluid joining operation to be conducted in accordance with the proportional valve delay characteristics as shown in the broken lines q1 and q2, while the increment instruction section 136 gives to the arm pump control section 137 an instruction for increasing the pump displacement in accordance with the pump increment delay characteristic as shown by the line "s" in FIG. 17.

Therefore, when the horizontal pulling work is being conducted, the proportional valve control section 134 commences the operation described before, i.e., the operation for controlling the solenoid proportional valves 127, 129 so as to open and close the boom fluid joining valve 123 and the cut valve 125 in accordance with the operation amount of the boom operation lever 100, only after the amount of operation of the boom operation lever 100 has been increased to the amount S2 which is greater than the operation amount S1 mentioned before. Similarly, the operation of the arm pump control section 137 commences the operation described before, i.e., the incremental control of the displacement rate of the hydraulic pump 99 so as to increase the displacement rate in accordance with the amount of operation of the boom operation lever 100, only after the amount of operation of the boom operation lever 100 has reached the above-mentioned operation amount S2.

As will be understood from the foregoing description, when the hydraulic excavator is in operation for the horizontal pulling work, the joining of the working fluid from the hydraulic pump 99 in the working fluid to be supplied to the boom actuating cylinders 5, 5 is commenced only when the operation amount of the boom operation lever 100 has reached the amount S2 which is greater than the aforesaid predetermined operation amount S1 at which the fluid joining operation would be commenced in usual operation other than the horizontal pulling work. Thus, the timing at which the fluid joining operation is commenced behind the timing in the usual operation by an amount corresponding to the difference $\Delta S$ ($\Delta S = S2 - S1$) of the operation amount of the boom operation lever 100.

Thus, the timing at which the fluid joining operation is commenced during the horizontal pulling work is delayed after the timing at which the joining operation would be commenced in usual operation. This ensures that the ranges of operations of the operation levers 100, 102, over which the supply of the working fluid to the boom actuating cylinders 5, 5 and to the arm actuating cylinder 6 solely from their associated hydraulic pumps 98 and 99, respectively, can be widened as compared with those in usual operation other than the horizontal pulling work. In other words, the boom actuating cylinders 5, 5 and the arm actuating cylinder 6 are controllable at comparatively low operation speeds, over wider ranges of operation of the respective operation levers 100 and 102. This assist the operator in operating the operation levers 100 and 102 for obtaining matching which is to be achieved between the operation speed of the boom actuating cylinders 5, 5 and the arm actuating cylinder 6 and which is important for the purpose of executing the horizontal pulling work. It is therefore possible to conduct the horizontal pulling work with a greater degree of ease than in known arts.

The fluid joining operation can be performed even during the horizontal pulling work, if only the boom operation lever 100 is operated by an amount which is not smaller than the above-mentioned operation amount S2, so that the operator can operate the boom actuating cylinders 5, 5 at greater speeds when he needs such a greater operation speed during the horizontal pulling work.

In the described fourth embodiment, the timing at which the boom fluid joining mechanism 121 starts to operates the boom fluid joining valve 123 and the cut valve 125 in accordance with the operation of the boom operation lever 100 is delayed behind the timing at which the same operation would be commenced in other type of work such as raising of the boom alone. This, however, is not exclusive and the arrangement may be such that the delay of the timing is effected only on the operation of one of the boom fluid joining valve 123 and the cut valve 125.

In addition, although in the described embodiment the hydraulic pumps 98, 99 are of variable displacement type, the invention does not exclude the use of constant displacement hydraulic pumps. When such constant displacement hydraulic pumps are used, it suffices to delay one or both of the operation of the boom fluid joining valve and the operation of the cut valve to be performed by the boom fluid joining mechanism 121.

In the fourth embodiment as described, delaying control is conducted both for the operation of the boom fluid joining mechanism 121 for operating the boom fluid joining valve 123 and the cut valve 125 and the operation for increasing the displacement rate of the hydraulic pump 99. This, however, is only illustrative and the forth embodiment may be modified such that the delaying control is effected only on the displacement rate increment control of the hydraulic pump 99, while eliminating the delay of the operation of the boom fluid joining mechanism 121 for operating the boom fluid joining valve 123 and the cut valve 125, i.e., while allowing the boom fluid joining mechanism 121 to operate the boom fluid joining valve 123 and the cut valve 125 in the same manner as that in ordinary work other than horizontal pulling work. In such a case, although the operation for opening the boom fluid joining valve 123 and the operation for closing the cut valve 125 are commenced without delay after the moment at which the operation amount reaches the amount S1, the control for increasing the displacement rate of the hydraulic pump 99 is not commenced at this moment because this control is delayed in accordance with the pump increment delay characteristic shown by the broken line "s" in FIG. 17. At this moment, therefore, the operation speed of the boom cylinders 5, 5 does not substantially increase, despite the non-delayed operation of the boom fluid joining valve 123 and the cut valve 125, because of insufficiency of the supply of the working fluid from the hydraulic pump 99 to the boom actuating cylinders 5, 5. Under such a condition, the operator can operate the boom actuating cylinders 5, 5 at comparatively low operation speed and, hence, can easily control the horizontal pulling work by obtain matching between the operation speed of the boom actuating cylinders 5, 5 and the Arm actuating cylinder 6.

The upper limit values (MAX) and gradients of the proportional valve delay characteristic and pump increment delay characteristic with respect to the amount of operation of the boom operation lever 100 are the same as those of proportional valve non-delay characteristic and pump increment non-delay characteristic, as will be seen from FIGS. 13, 14 and 17. This, however, is only illustrative and the fourth embodiment may be modified such that the upper limit values of the proportional valve delay characteristic and pump increment delay characteristic are set to levels lower than those in the proportional valve non-delay characteristic and pump increment non-delay characteristic, and such that the gradients of the proportional valve delay characteristic and pump increment delay characteristic are set to be smaller than those in the proportional valve non-delay characteristic and pump increment non-delay characteristic.

The fourth embodiment also may have an operation switch 141 shown by imaginary lines in FIG. 12 and serving as control prohibiting means 141 for selectively prohibiting the delaying controltobeperformedbythecontroller133. When this switch is ON, the control for delaying the fluid joining operation is performed as described, whereas, when this switch is OFF, the control for delaying the fluid joining operation is not conducted. Thus, in the latter case, the boom fluid joining valve 123, cut valve 125 and the hydraulic pump 99 are operated in the same manner as that in the usual operation of the hydraulic excavator. Thus, the hydraulic excavator can efficiently perform any work which is other than the horizontal pulling work and which also requires simultaneous boom raising and arm pulling operations, when the operation switch 141 has been turned OFF.

The above-described operation switch 141 may be provided also in the aforesaid modification in which the delaying control is effected only on the displacement increment control of the hydraulic pump 99 without causing delay of the operations of the boom fluid joining valve 123 and the cut valve 125. When the operation switch is used in this modification of the fourth embodiment, the arrangement may be such that the control for delaying the operation for increasing the displacement rate of the hydraulic pump 99 is not performed when the operation switch is OFF.

What is claimed is:

1. A hydraulic excavator, comprising:

a hydraulic pump;

a boom actuating cylinder and an arm actuating cylinder;

a boom spool valve provided in a boom actuating fluid supply passage through which the working fluid is supplied from said hydraulic pump to said boom actuating cylinder;

an arm spool valve provided in an arm actuating fluid supply passage through which the working fluid is supplied from said hydraulic pump to said arm actuating cylinder;

a boom operation lever associated with said boom spool valve, for allowing the working fluid to be supplied from said hydraulic pump to said boom actuating cylinder at a rate which corresponds to the amount of operation thereof;

an arm operation lever associated with said arm spool valve, for allowing the working fluid to be supplied from said hydraulic pump to said arm actuating cylinder at a rate which corresponds to the amount of operation thereof;

boom operation data detecting means for detecting data indicative of the amount of operation of said boom operation lever for raising the boom;

arm operation data detecting means for detecting data indicative of the amount of operation of said arm operation lever for causing a pulling action of the arm; and suppressing means for suppressing cutting of a bucket into the ground or floating of the bucket above the ground, when both said boom operation lever and said arm operation lever are simultaneously in operation for raising the boom and pulling the arm, respectively, on condition that the difference between the value of the data detected by said arm operation data detecting means and the value of the data detected by said boom operation data detecting means does not fall within a predetermined range.

2. A hydraulic excavator, comprising:

a hydraulic pump;

a boom actuating cylinder and an arm actuating cylinder;

a boom spool valve provided in a boom actuating fluid supply passage through which the working fluid is supplied from said hydraulic pump to said boom actuating cylinder;

an arm spool valve provided in an arm actuating fluid supply passage through which the working fluid is supplied from said hydraulic pump to said arm actuating cylinder;

a boom operation lever associated with said boom spool valve, for allowing the working fluid to be supplied from said hydraulic pump to said boom actuating cylinder at a rate which corresponds to the amount of operation thereof;

an arm operation lever associated with said arm spool valve, for allowing the working fluid to be supplied from said hydraulic pump to said arm actuating cylinder at a rate which corresponds to the amount of operation thereof;

boom operation data detecting means for detecting data indicative of the amount of operation of said boom operation lever for raising the boom;

arm operation data detecting means for detecting data indicative of the amount of operation of said arm operation lever for causing a pulling action of the arm; and arm actuating cylinder retarding means for reducing the rate of supply of the working fluid to said arm actuating cylinder down to a rate corresponding to the rate of supply of the working fluid to said boom actuating cylinder, when both said boom operation lever and said arm operation lever are simultaneously in operation for raising the boom and pulling the arm, respectively, on condition that the ratio of the value of the data detected by said arm operation data detecting means to the value of the data detected by said boom operation data detecting means is not smaller than a predetermined value.

3. A hydraulic excavator according to claim 2, wherein said arm spool valve being adapted to be supplied with a pilot pressure corresponding to the amount of operation of said arm operation lever, thereby allowing the supply of the working fluid to the arm actuating cylinder at a rate corresponding to the amount of operation of said arm operating lever.

4. A hydraulic excavator according to claim 3, wherein said arm actuating cylinder retarding means operates to reduce the pilot pressure supplied to said arm spool valve to a level corresponding to the amount of operation of said boom operation lever, thereby reducing the rate of supply of the working fluid to said arm actuating cylinder to a rate corresponding to the amount of operation of said boom operation lever, when both said boom operation lever and said arm operation lever are simultaneously in operation for raising the boom and pulling the arm, respectively, on condition that the ratio of the value of the data detected by said arm operation data detecting means to the value of the data detected by said boom operation data detecting means is not smaller than a predetermined value.

5. A hydraulic excavator according to claim 2, further comprising:

boom actuating cylinder retarding means for reducing the rate of supply of the working fluid to said boom actuating cylinder to a rate corresponding to the amount of operation of said arm operation lever, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

6. A hydraulic excavator according to claim 5, wherein said boom spool valve is supplied with a pilot pressure corresponding to the amount of operation of said boom operation lever, so as to be driven to a state in which said boom spool valve allows the working fluid to be supplied to said boom actuating cylinder at the rate corresponding to the amount of operation of said boom operation lever.

7. A hydraulic excavator according to claim 6, wherein said boom actuating cylinder retarding means operates to reduce the pilot pressure supplied to said boom spool valve to a level corresponding to the amount of operation of said arm operation lever, thereby reducing the rate of supply of the working fluid to said boom actuating cylinder to a rate corresponding to the amount of operation of said arm operation lever, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

8. A hydraulic excavator according to claim 2, wherein said hydraulic pump includes a first variable displacement hydraulic pump for supplying the working fluid to said boom actuating cylinder and a second variable displacement hydraulic pump for supplying the working fluid to said arm actuating cylinder.

9. A hydraulic excavator according to claim 8, further comprising: first hydraulic pump controlling means for controlling the displacement rates of said first and second variable displacement hydraulic pumps in accordance with the amounts of operation of said boom operation lever and said arm operation lever.

10. A hydraulic excavator according to claim 9, wherein said first hydraulic pump controlling means operates to reduce the displacement rate of the hydraulic pump associated with said arm actuating cylinder to a rate corresponding to the amount of operation of said boom operation lever, when both said boom operation lever and said arm operation lever are simultaneously in operation for raising the boom and pulling the arm, respectively, on condition that the ratio of the value of the data detected by said arm operation data detecting means to the value of the data detected by said boom operation data detecting means is not smaller than a predetermined value.

11. A hydraulic excavator according to claim 9, wherein said first hydraulic pump controlling means operates to reduce the displacement rate of the hydraulic pump associated with said boom actuating cylinder to a rate corresponding to the amount of operation of said arm operation lever, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

12. A hydraulic excavator according to claim 9, wherein, when both said boom operation lever and said arm operation lever are simultaneously in operation for raising the boom and for pulling the arm, respectively, said first hydraulic pump controlling means operates to reduce the displacement rate of the hydraulic pump associated with said arm actuating cylinder to a rate corresponding to the amount of operation of said boom operation lever, on condition that the ratio of the value of the data detected by said arm operation data detecting means to the value of the data detected by said boom operation data detecting means is not smaller than a predetermined value, and to reduce the displacement rate of the hydraulic pump associated with said boom actuating cylinder to a rate corresponding to the amount of operation of said arm operation lever, on condition that the ratio of the value of the data detected by said boom operation data detecting means to the value of the data detected by said arm operation data detecting means is not smaller than a predetermined value.

13. A hydraulic excavator, comprising:

a hydraulic pump;

a boom actuating cylinder and an arm actuating cylinder;

a boom spool valve provided in a boom actuating fluid supply passage through which the working fluid is supplied from said hydraulic pump to said boom actuating cylinder;

an arm spool valve provided in an arm actuating fluid supply passage through which the working fluid is supplied from said hydraulic pump to said arm actuating cylinder;

a boom operation lever associated with said boom spool valve, for allowing the working fluid to be supplied from said hydraulic pump to said boom actuating cylinder at a rate which corresponds to the amount of operation thereof;

an arm operation lever associated with said arm spool valve, for allowing the working fluid to be supplied from said hydraulic pump to said arm actuating cylinder at a rate which corresponds to the amount of operation thereof;

boom operation data detecting means for detecting data indicative of the amount of operation of said boom operation lever for raising the boom;

arm operation data detecting means for detecting data indicative of the amount of operation of said arm operation lever for causing a pulling action of the arm; and boom actuating cylinder retarding means for reducing the rate of supply of the working fluid to said boom actuating cylinder down to a rate corresponding to t he rate of supply of the working fluid to said arm actuating cylinder, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

14. A hydraulic excavator according to claim 13, wherein said boom spool valve being adapted to be supplied with a pilot pressure corresponding to the amount of operation of said boom operation lever, thereby allowing the supply of the working fluid to said boom actuating cylinder at a rate corresponding to the amount of operation of said boom operating lever.

15. A hydraulic excavator according to claim 14, wherein said boom actuating cylinder retarding means operates to reduce the pilot pressure supplied to said boom spool valve to a level corresponding to the amount of operation of said arm operation lever, thereby reducing the rate of supply of the working fluid to said boom actuating cylinder to a rate corresponding to the amount of operation of said arm operation lever, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

16. A hydraulic excavator according to claim 13, wherein said hydraulic pump includes a first variable displacement hydraulic pump for supplying the working fluid to said boom actuating cylinder and a second variable displacement hydraulic pump for supplying the working fluid to said arm actuating cylinder.

17. A hydraulic excavator according to claim 16, further comprising: second hydraulic pump controlling means for controlling the displacement rates of said first and second variable displacement hydraulic pumps in accordance with the amounts of operation of said boom operation lever and said arm operation lever.

18. A hydraulic excavator according to claim 17, wherein said first hydraulic pump controlling means operates to reduce the displacement rate of the hydraulic pump associated with said boom actuating cylinder to a rate corresponding to the amount of operation of said arm operation lever, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

19. A hydraulic excavator, comprising:

a boom actuating cylinder;

a first variable displacement hydraulic pump for supplying the working fluid to said boom actuating cylinder;

an arm actuating cylinder;

a second variable displacement hydraulic pump for supplying the working fluid to said arm actuating cylinder;

a boom spool valve provided in a boom actuating fluid supply passage through which the working fluid is supplied from said first variable displacement hydraulic pump to said boom actuating cylinder;

an arm spool valve provided in an arm actuating fluid supply passage through which the working fluid is supplied from said second variable displacement hydraulic pump to said arm actuating cylinder;

a boom operation lever for controlling the state of said boom spool valve and the displacement rate of said first variable displacement hydraulic pump in accordance with the amount of operation thereof;

an arm operation lever for controlling the state of said arm spool valve and the displacement rate of said second variable displacement hydraulic pump in accordance with the amount of operation thereof;

boom operation data detecting means for detecting data indicative of the amount of operation of said boom operation lever for raising the boom;

arm operation data detecting means for detecting data indicative of the amount of operation of said arm operation lever for causing a pulling action of the arm; and third hydraulic pump control means for reducing the rate of supply of the working fluid from said first variable displacement hydraulic pump to a value corresponding to the amount of operation of said arm operation lever, when both said boom operation lever and said arm operation lever are simultaneously in operation for raising the boom and pulling the arm, respectively, on condition that the ratio of the value of the data detected by said boom operation data detecting means to the value of the data detected by said arm operation data detecting means is not smaller than a predetermined value.

20. A hydraulic excavator according to claim 2, further comprising first prohibiting means for prohibiting, in accordance with a predetermined operation, the operation for reducing the rate of supply of the working fluid to said arm actuating cylinder performed by said arm actuating cylinder retarding means.

21. A hydraulic excavator according to claim 13, further comprising second prohibiting means for prohibiting, in accordance with a predetermined operation, the operation for reducing the rate of supply of the working fluid to said boom actuating cylinder performed by said boom actuating cylinder retarding means.

22. A hydraulic excavator according to claim 19, further comprising third prohibiting means for prohibiting, in accordance with a predetermined operation, the operation for reducing the delivery rate of said first variable displacement hydraulic pump performed by said third hydraulic pump controlling means.

23. A hydraulic excavator, comprising:

a hydraulic pump;

a boom actuating cylinder and an arm actuating cylinder;

a boom spool valve provided in a boom actuating fluid supply passage through which the working fluid is supplied from said hydraulic pump to said boom actuating cylinder;

an arm spool valve provided in an arm actuating fluid supply passage through which the working fluid is supplied from said hydraulic pump to said arm actuating cylinder;

a boom operation lever associated with said boom spool valve, for allowing the working fluid to be supplied from said hydraulic pump to said boom actuating cylinder at a rate which corresponds to the amount of operation thereof;

an arm operation lever associated with said arm spool valve, for allowing the working fluid to be supplied from said hydraulic pump to said arm actuating cylinder at a rate which corresponds to the amount of operation thereof;

a variable orifice defining a fluid passage of variable area, provided in a conduit through which the fluid is displaced from the rod-side hydraulic chamber of said arm actuating cylinder during arm pulling operation of said arm actuating cylinder; and variable orifice controlling means for controlling, when both said boom operation lever and said arm operation lever are simultaneously in operation for raising the boom and pulling the arm, respectively, said variable orifice such that the area of the fluid passage in said variable orifice is smaller when the amount of operation of said boom operation lever is smaller.

24. A hydraulic excavator according to claim 23, wherein said hydraulic pump includes separate variable displacement hydraulic pumps used for said boom actuating cylinder and said arm actuating cylinder, respectively.

25. A hydraulic excavator according to claim 24, further comprising: fourth hydraulic pump controlling means for controlling the displacement rates of said variable displacement hydraulic pumps in accordance with the amounts of operations of said boom operating lever and said arm operating lever, respectively.

26. A hydraulic excavator according to claim 25, wherein, when both said boom operation lever and said arm operation lever are simultaneously in operation for raising the boom and for pulling the arm. respectively, said fourth hydraulic pump controlling means controls the displacement rate of said variable displacement hydraulic pump associated with said arm actuating cylinder, in accordance with the smaller one of the amount of operation of said boom operation lever and the amount of operation of said arm operation lever.

27. A hydraulic excavator according to claim 26, further comprising: pump gain setting means which, when both said boom operation lever and said arm operation lever are simultaneously in operation for raising the boom and for pulling the arm respectively, selectively sets a plurality of control characteristics of said fourth hydraulic pump controlling means so as to provide a plurality of classes of displacement varying characteristics of said variable displacement hydraulic pumps in relation to the amounts of operations of the respective operation levers.

28. A hydraulic excavator according to claim 23, further comprising: variable orifice gain setting means for varying the characteristic in accordance with which the amount of variation of the passage area in said variable orifice varies for a given amount of operation of said boom operation lever.

29. A hydraulic excavator according to claim 23, further comprising:

a returning circuit for returning, during the operation of said arm actuating cylinder for pulling the arm, the working fluid displaced from the rod-side chamber of said arm actuating cylinder back to the bottom-side chamber of said arm actuating cylinder, said variable orifice being provided in said returning circuit.

30. A hydraulic excavator according to claim 23, further comprising variable-orifice control prohibiting means for prohibiting, in accordance with a predetermined operation, the control of the passage area in said variable orifice performed by said variable orifice controlling means.

31. A hydraulic excavator, comprising:

a boom actuating cylinder;

a first variable displacement hydraulic pump for supplying the working fluid to said boom actuating cylinder;

an arm actuating cylinder;

a second variable displacement hydraulic pump for supplying the working fluid to said arm actuating cylinder;

a boom spool valve provided in a boom actuating fluid supply passage through which the working fluid is supplied from said first variable displacement hydraulic pump to said boom actuating cylinder;

an arm spool valve provided in an arm actuating fluid supply passage through which the working fluid is supplied from said second variable displacement hydraulic pump to said arm actuating cylinder;

a boom operation lever for controlling the state of said boom spool valve and the displacement rate of said first variable displacement hydraulic pump in accordance with the amount of operation thereof;

an arm operation lever for controlling the state of said arm spool valve and the displacement rate of said second variable displacement hydraulic pump in accordance with the amount of operation thereof;

boom fluid joining means for joining, during operation of said boom actuating cylinder, the working fluid displaced from said second variable displacement hydraulic pump to the working fluid displaced from said first variable displacement hydraulic pump so that the working fluid from said second variable displacement hydraulic pump is also supplied to said boom actuating cylinder together with the working fluid displaced from said first variable displacement hydraulic pump, in accordance with the operation of said boom operation lever; and first fluid joining delay means for delaying, when both said boom operation lever and said arm operation lever are simultaneously in operation for raising the boom and for pulling the arm, respectively, the timing of start of the joining of the working fluid performed by said boom fluid joining means behind, at the earliest, the timing at which the joining is commenced when said boom operation lever alone is operated.

32. A hydraulic excavator according to claim 31, wherein said boom fluid joining means includes: a boom fluid joining valve for selectively opening and closing the passage of the working fluid leading from said second variable displacement hydraulic pump to said boom actuating cylinder; and a cut valve provided in a fluid passage through which the working fluid displaced from said second variable displacement hydraulic pump is returned to a working fluid tank, when said arm spool valve is in neutral position as a result of setting of said arm operation lever at neutral position.

33. A hydraulic excavator according to claim 32, wherein said boom fluid joining means, when performing the fluid joining operation during operation of said boom actuating cylinder, operates in accordance with the operation of said boom operation lever so as to open said boom fluid joining valve and to close said cut valve, whereby the working fluid from said second variable displacement hydraulic pump joins in the working fluid from said first variable displacement hydraulic pump so as to be supplied together therewith to said boom actuating cylinder.

34. A hydraulic excavator according to claim 32, wherein said first fluid joining delaying means delays at least one of the timing of operation for opening said fluid joining valve and the timing of closing of said cut valve, behind the timing at which the operation would be performed when said boom operation lever alone is operated.

35. A hydraulic excavator according to claim 31, further comprising: delay control prohibiting means for prohibiting, in accordance with a predetermined operation, the operation for delaying the timing of commencement of the fluid joining operation performed by said first fluid joining delaying means.

36. A hydraulic excavator, comprising:

a boom actuating cylinder;

a first variable displacement hydraulic pump for supplying the working fluid to said boom actuating cylinder;

an arm actuating cylinder;

a second variable displacement hydraulic pump for supplying the working fluid to said arm actuating cylinder;

a boom spool valve provided in a boom actuating fluid supply passage through which the working fluid is supplied from said first variable displacement hydraulic pump to said boom actuating cylinder;

an arm spool valve provided in an arm actuating fluid supply passage through which the working fluid is supplied from said second variable displacement hydraulic pump to said arm actuating cylinder;

a boom operation lever for controlling the state of said boom spool valve and the displacement rate of said first variable displacement hydraulic pump in accordance with the amount of operation thereof;

an arm operation lever for controlling the state of said arm spool valve and the displacement rate of said second variable displacement hydraulic pump in accordance with the amount of operation thereof;

boom fluid joining means for joining, during operation of said boom actuating cylinder, the working fluid displaced from said second variable displacement hydraulic pump to the working fluid displaced from said first variable displacement hydraulic pump so that the working fluid from said second variable displacement hydraulic pump is also supplied to said boom actuating cylinder together with the working fluid displaced from said first variable displacement hydraulic pump, in accordance with the operation of said boom operation lever;

fifth hydraulic pump controlling means which, during operation of each of said operation levers, the displacement rate of the associated variable displacement hydraulic pump to a rate corresponding to the amount of operation of said operation lever, said fifth hydraulic means being further operative to increase, when the boom fluid joining means operates to perform the fluid joining operation, the displacement of said second variable displacement hydraulic pump by an amount corresponding to the amount of operation of said boom operation lever; and pump displacement increment delaying means for delaying, when both said boom operation lever and said arm operation lever are simultaneously in operation for raising the boom and for pulling the arm, respectively, the timing of start of the increment of the displacement rate of said second variable displacement hydraulic pump performed by said fifth hydraulic pump control means behind, at the earliest, the timing at which the increment is commenced when said boom operation lever alone is operated.

37. A hydraulic excavator according to claim 36, further comprising:

second fluid joining delaying means which, when both said boom operation lever and said arm operation lever are simultaneously in operations for raising the boom and for pulling the arm, respectively, operates in accordance with the delay of the timing of commencement of increment of said second variable displacement hydraulic pump performed by said pump displacement increment delaying means, so as to delay the timing of commencement of the fluid joining operation performed by said boon fluid joining means, behind the timing at which the fluid joining operation would be commenced when said boom operation lever alone is operated.

38. A hydraulic excavator according to claim 37, wherein said boom fluid joining means includes: a boom fluid joining valve for selectively opening and closing the passage of the working fluid leading from said second variable displacement hydraulic pump to said boom actuating cylinder; and a cut valve provided in a fluid passage through which the working fluid displaced from said second variable displacement hydraulic pump is returned to a working fluid tank, when said arm spool valve is i n neutral position as a result of setting of said arm operation lever at neutral position.

39. A hydraulic excavator according to claim 38, wherein said boom fluid joining means, when performing the fluid joining operation during operation of said boom actuating cylinder, operates in accordance with the operation of said boom operation lever so as to open said boom fluid joining valve and to close said cut valve, whereby the working fluid from said second variable displacement hydraulic pump joins in the working fluid from said first variable displacement hydraulic pump so as to be supplied together therewith to said boom actuating cylinder.

40. A hydraulic excavator according to claim 37, wherein said second fluid joining delaying means delays at least one of the timing of operation for opening said fluid joining valve and the timing of closing of said cut valve, behind the timing at which the operation would be performed when said boom operation lever alone is operated.

41. A hydraulic excavator according to claim 36, further comprising: control prohibiting means for prohibiting, in accordance with a predetermined operation, the delay of the timing of commencement of the increment of the displacement rate of said second variable displacement hydraulic pump performed by said pump displacement increment delaying means.

* * * * *